US009534596B2

(12) United States Patent
Watanabe et al.

(10) Patent No.: US 9,534,596 B2
(45) Date of Patent: Jan. 3, 2017

(54) VARIABLE DISPLACEMENT PUMP

(71) Applicant: HITACHI AUTOMOTIVE SYSTEMS, LTD., Hitachinaka-shi, Ibaraki (JP)

(72) Inventors: Yasushi Watanabe, Kanagawa (JP); Koji Saga, Ebina (JP); Hideaki Ohnishi, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 249 days.

(21) Appl. No.: 14/086,473

(22) Filed: Nov. 21, 2013

(65) Prior Publication Data

US 2014/0147323 A1 May 29, 2014

(30) Foreign Application Priority Data

Nov. 27, 2012 (JP) ..... 2012-258828

(51) Int. Cl.
*F04C 14/22* (2006.01)
*F04C 2/344* (2006.01)
(Continued)

(52) U.S. Cl.
CPC ..... *F04C 2/3442* (2013.01); *F04C 14/226* (2013.01); *F04B 49/002* (2013.01); *F04B 49/125* (2013.01);
(Continued)

(58) Field of Classification Search
CPC . F04C 2/3443; F04C 14/226; F04C 2210/206; F04C 2270/185; F04C 14/18; F04C 14/20; F04C 14/22; F04C 14/28; F04C 14/223; F04C 28/18; F04C 28/22; F04C 15/06; F04C 2270/01; F04C 2270/015; F04C 2270/20; F04C 2270/205; F04C 2270/58; F04C 2270/585; F04B 49/002; F04B 49/12; F04B 49/123; F04B 49/125; F16K 11/07; F16K 11/0712; Y10T 137/86879
(Continued)

(56) References Cited

U.S. PATENT DOCUMENTS 2,411,930 A * 12/1946 Mathys ..... G05D 16/10 137/470
4,035,105 A * 7/1977 Dantlgraber ..... F04C 14/223 417/220
(Continued)

FOREIGN PATENT DOCUMENTS

JP 5-52188 A 3/1993
JP 2011-111926 6/2011
(Continued)

*Primary Examiner* — Devon Kramer
*Assistant Examiner* — Connor Tremarche
(74) *Attorney, Agent, or Firm* — Foley & Lardner LLP

(57) ABSTRACT

A variable displacement pump including a control mechanism shiftable between first and second states, when the control mechanism is in the first state, the spool is in an initial position in which fluid communication between an introduction port and the remaining ports is restrained, fluid communication between a first control port and a drain port is allowed, and fluid communication between a second control port and the drain port is restrained, and when the control mechanism is shifted to the second state in accordance with increase in fluid pressure discharged, the spool is in an operating position in which the fluid communication between the introduction port and the first control port is allowed, the fluid communication between the first control port and the drain port is restrained, and the fluid communication between the second control port and the drain port is allowed.

9 Claims, 13 Drawing Sheets

(51) Int. Cl.
*F04B 49/00* (2006.01)
*F04B 49/12* (2006.01)

(52) U.S. Cl.
CPC .... *F04C 2210/206* (2013.01); *F04C 2270/185* (2013.01); *F04C 2270/58* (2013.01); *F04C 2270/585* (2013.01)

(58) Field of Classification Search
USPC ... 417/220; 418/20–27, 30, 138; 137/625.48
See application file for complete search history.

(56) References Cited

U.S. PATENT DOCUMENTS 4,674,956 A * 6/1987 Dantlgraber ..... F04B 49/08 417/220
5,052,896 A * 10/1991 Fischer ..... F04B 49/08 417/220
5,190,446 A * 3/1993 Salter ..... F04B 7/0076 417/297
6,004,111 A * 12/1999 Miyazaki ..... F15B 11/05 417/310
6,086,337 A * 7/2000 Watanabe ..... F04C 14/12 417/302
6,155,797 A * 12/2000 Kazuyoshi ..... F04C 14/226 417/220
6,352,085 B1 * 3/2002 Morita ..... F01M 1/20 137/516.27
6,530,752 B2 * 3/2003 Oba ..... F04C 14/226 417/220
6,790,013 B2 * 9/2004 Hunter ..... F01C 21/0836 184/6.16
6,896,489 B2 * 5/2005 Hunter ..... F01C 21/0836 417/220
7,011,069 B2 * 3/2006 Ono ..... F04C 14/065 123/196 R
7,827,947 B2 * 11/2010 Ichinosawa ..... F04C 11/006 123/90.15
8,075,291 B2 * 12/2011 Lee ..... F04C 18/0215 418/270
8,142,173 B2 * 3/2012 Saga ..... F04C 2/3442 417/364
8,202,061 B2 * 6/2012 Shulver ..... F01M 1/16 417/212
8,297,943 B2 * 10/2012 Shulver ..... F04C 2/102 137/529
8,342,815 B2 * 1/2013 Watanabe ..... F04C 2/102 417/213
8,342,817 B2 * 1/2013 Fujita ..... F04C 14/226 417/220
8,348,646 B2 * 1/2013 Fujita ..... F04C 14/226 417/220
8,434,508 B2 * 5/2013 Terada ..... F16K 17/06 137/115.13
8,602,748 B2 * 12/2013 Armenio ..... F04C 14/223 417/220
8,613,610 B2 * 12/2013 Saga ..... F04C 2/3442 418/24
8,690,544 B2 * 4/2014 Ono ..... F04C 2/102 417/213
8,763,634 B2 * 7/2014 Akaishi ..... F01M 1/16 137/512.5
8,967,195 B2 * 3/2015 Williamson ..... F16K 15/025 137/512.5
9,004,882 B2 * 4/2015 Ohnishi ..... F04C 14/223 417/212
9,109,596 B2 * 8/2015 Ohnishi ..... F04C 2/344
9,163,630 B2 * 10/2015 Hadar ..... F01C 21/0845
2008/0170950 A1 * 7/2008 Merz ..... F04C 14/223 417/220
2009/0081052 A1 * 3/2009 Soeda ..... F04C 2/3442 417/213
2009/0269233 A1 * 10/2009 Fujita ..... F04C 14/226 418/26
2010/0028171 A1 * 2/2010 Shulver ..... F01M 1/16 417/307
2010/0221126 A1 * 9/2010 Tanasuca ..... F04C 14/226 417/218
2011/0123379 A1 * 5/2011 Saga ..... F04C 2/3442 418/26
2011/0194967 A1 * 8/2011 Watanabe ..... F04C 14/226 418/138
2012/0213655 A1 * 8/2012 Ohnishi ..... F04C 2/3442 418/24
2013/0028770 A1 * 1/2013 Niwata ..... F01C 21/108 418/25
2013/0164162 A1 * 6/2013 Saga ..... F04C 14/226 418/24
2013/0164163 A1 * 6/2013 Ohnishi ..... F04C 2/344 418/27
2014/0147322 A1 * 5/2014 Saga ..... F04C 2/344 418/24
2014/0219847 A1 * 8/2014 Watanabe ..... F04C 2/3442 418/24
2015/0020759 A1 * 1/2015 Watanabe ..... F04C 2/3442 123/90.15
2015/0107686 A1 * 4/2015 Watanabe ..... F01M 1/16 137/102
2015/0110659 A1 * 4/2015 Saga ..... F04C 2/3441 418/26
2015/0218983 A1 * 8/2015 Watanabe ..... F04C 2/3442 210/130
2015/0252803 A1 * 9/2015 Ohnishi ..... F01M 1/02 418/26

FOREIGN PATENT DOCUMENTS

JP 2011-140918 A 7/2011
JP 2012-077754 A 4/2012

* cited by examiner

VARIABLE DISPLACEMENT PUMP

BACKGROUND OF THE INVENTION

The present invention relates to a variable displacement pump applicable to, for instance, a hydraulic source that supplies a working oil to sliding parts of an internal combustion engine for a vehicle.

Japanese Patent Application Unexamined Publication No. 2011-111926 A discloses a variable displacement pump for use in an internal combustion engine for a vehicle. Briefly explained, the variable displacement pump includes a cam ring, a pair of springs disposed to apply a displacement force to the cam ring in a direction in which an eccentric amount of a central axis of the cam ring with respect to a rotation axis of a rotor is increased as a whole (hereinafter referred to as "an eccentric direction"), and a pair of control fluid chambers configured to apply a displacement force to the cam ring in a direction in which the eccentric amount of the central axis of the cam ring is reduced as a whole (hereinafter referred to as "a concentric direction") by introducing same discharge fluid pressure into an inside of each of the control fluid chambers. The springs are arranged such that biasing forces thereof are exerted on the cam ring in directions opposed to each other. As the eccentric amount of the central axis of the cam ring is reduced, a load that is applied to the cam ring in the concentric direction is discontinuously and stepwise increased. With this construction, the variable displacement pump has a two-stage discharge fluid pressure characteristic in which a first predetermined fluid pressure is retained in a first rotation speed range and a second predetermined fluid pressure is retained in a second rotation speed range. The discharge fluid pressure characteristic is brought close to a required fluid pressure characteristic of the engine, so that useless energy consumption can be lowered.

SUMMARY OF THE INVENTION

However, in the above conventional variable displacement pump, the springs are used for restricting movement of the cam ring as described above, and therefore, in accordance with increase in discharge fluid pressure, the cam ring cannot be readily displaced. Accordingly, even if it is intended to retain the discharge fluid pressure at the first or second predetermined fluid pressure, the discharge fluid pressure is largely increased as engine rotation speed becomes higher. As a result, there occurs such a problem that the discharge fluid pressure characteristic of the variable displacement pump is deviated from the required fluid pressure characteristic of the engine.

The present invention has been made in view of a technological problem of the conventional variable displacement pump. It is an object of the present invention to provide a variable displacement pump in which when retention of a desired discharge fluid pressure is required, the discharge fluid pressure required can be possibly retained even in a case where engine rotation speed (pump rotation speed) is increased.

In a first aspect of the present invention, there is provided a variable displacement pump including:

a rotor disposed to be driven to rotate about a rotation axis;

a plurality of vanes disposed on an outer peripheral portion of the rotor so as to be moveable to project from the rotor and retreat into the rotor;

a cam ring accommodating the rotor and the plurality of vanes in an inner peripheral side thereof, the cam ring cooperating with the rotor and the plurality of vanes to define a plurality of working fluid chambers, the cam ring being moveable to vary an eccentric amount of a central axis thereof with respect to the rotation axis of the rotor such that a volume of each of the working fluid chambers is increased and decreased during rotation of the rotor, end walls disposed at opposite axial ends of the cam ring, respectively, at least one of the end walls comprising a suction portion and a discharge portion, the suction portion being opened to the working fluid chambers that are increased in volume when the cam ring is in an eccentric state, the discharge portion being opened to the working fluid chambers that are decreased in volume when the cam ring is in the eccentric state, a biasing mechanism including two biasing members disposed with preloads, respectively, the biasing mechanism being constructed to bias the cam ring in a direction in which the eccentric amount is increased in accordance with a biasing force generated by the two biasing members, the biasing mechanism being constructed to stepwise increase the biasing force when the eccentric amount becomes not larger than a predetermined amount, a first control fluid chamber into which a working fluid discharged from the discharge portion is introduced, the first control fluid chamber serving to apply an urging force to the cam ring in accordance with an inside pressure thereof in a direction in which the eccentric amount is reduced against the biasing force of the biasing mechanism, a second control fluid chamber into which the working fluid discharged from the discharge portion is introduced through an orifice, the second control fluid chamber cooperating with the biasing mechanism to apply an urging force to the cam ring in accordance with an inside pressure thereof in the direction in which the eccentric amount is increased, and a control mechanism serving to control movement of the cam ring, the control mechanism including a valve body, a spool slidably accommodated in a side of one axial end of the valve body and a control spring accommodated in a side of the other axial end of the valve body, the valve body including an introduction port disposed at the one axial end of the valve body, the introduction port serving to introduce the working fluid discharged into the valve body, a first control port communicated with the first control fluid chamber, a second control port communicated with the second control fluid chamber and a drain port communicated with a low fluid pressure portion, the spool carrying out changeover of fluid communication between the introduction port, the first control port, the second control port and the drain port corresponding to a position of the spool in an axial direction of the valve body with respect to the valve body, the control spring biasing the spool toward the one axial end of the valve body with a biasing force smaller than the biasing force of the biasing mechanism, wherein the control mechanism is shiftable between a first state and a second state in response to fluid pressure discharged from the discharge portion, when the control mechanism is in the first state, the spool is urged to move toward the one axial end of the valve body to a maximum extent by the control spring to be in an initial position in which fluid communication between the introduction port and the remaining ports is restrained, fluid communication between the first control port and the drain port is allowed, and fluid communication between the second control port and the drain port is restrained, and when the control mechanism is shifted to the second state in accordance with increase in the fluid pressure discharged, the spool is urged to move toward the other axial end of the valve body to be in an operating position in which the fluid communication between the introduction port and the first control port is allowed, the fluid communication between the first control port and the drain port is restrained, and the fluid communication between the second control port and the drain port is allowed.

In a second aspect of the present invention, there is provided the variable displacement pump according to the first aspect, wherein the spool includes large diameter lands formed on opposite axial ends of the spool such that the large diameter lands are slidable relative to the valve body, and a small diameter portion between the large diameter lands, the small diameter portion serving to allow fluid communication between the first control port and the drain port or fluid communication between the second control port and the drain port, the large diameter lands serving to restrain fluid communication between the second control port and the drain port.

In a third aspect of the present invention, there is provided the variable displacement pump according to the first aspect, wherein the introduction port is opened to an end surface at the one axial end of the valve body.

In a fourth aspect of the present invention, there is provided the variable displacement pump according to the first aspect, wherein one of the two biasing members applies the biasing force to the cam ring in the direction in which the eccentric amount is increased, and the other of the two biasing members applies the biasing force to the cam ring in the direction in which the eccentric amount is reduced.

In a fifth aspect of the present invention, there is provided the variable displacement pump according to the first aspect, wherein the first control fluid chamber and the second control fluid chamber are disposed on an outer peripheral side of the cam ring.

In a sixth aspect of the present invention, there is provided the variable displacement pump according to the first aspect, wherein the working fluid discharged is used to lubricate an internal combustion engine.

In a seventh aspect of the present invention, there is provided the variable displacement pump according to the sixth aspect, wherein the working fluid discharged is used in an oil jet device that supplies the working fluid to a drive source of a variable valve operating mechanism and a piston of the internal combustion engine.

In an eighth aspect of the present invention, there is provided a variable displacement pump including:

a rotor disposed to be driven to rotate about a rotation axis;

a plurality of vanes disposed on an outer peripheral side of the rotor so as to be moveable to project from the rotor and retreat into the rotor;

a cam ring accommodating the rotor and the plurality of vanes in an inner peripheral side thereof, the cam ring cooperating with the rotor and the plurality of vanes to define a plurality of working fluid chambers, the cam ring being moveable to vary an eccentric amount of a central axis thereof with respect to the rotation axis of the rotor such that a volume of each of the working fluid chambers is increased and decreased during rotation of the rotor, end walls disposed at opposite axial ends of the cam ring, respectively, at least one of the end walls including a suction portion and a discharge portion, the suction portion being opened to the working fluid chambers that are increased in volume when the cam ring is in an eccentric state, the discharge portion being opened to the working fluid chambers that are decreased in volume when the cam ring is in the eccentric state, a biasing mechanism including two biasing members disposed with preloads, respectively, the biasing mechanism being constructed to bias the cam ring in a direction in which the eccentric amount is increased in accordance with a biasing force generated by the two biasing members, the biasing mechanism being constructed to stepwise increase the biasing force when the eccentric amount becomes not larger than a predetermined amount, a first control fluid chamber into which a working fluid discharged from the discharge portion is introduced, the first control fluid chamber serving to apply an urging force to the cam ring in accordance with an inside pressure thereof in a direction in which the eccentric amount is reduced against the biasing force of the biasing mechanism, a second control fluid chamber into which the working fluid discharged from the discharge portion is introduced through an orifice, the second control fluid chamber cooperating with the biasing mechanism to apply an urging force to the cam ring in accordance with an inside pressure thereof in the direction in which the eccentric amount is increased, and a control mechanism serving to control movement of the cam ring, the control mechanism being operated before the eccentric amount becomes a minimum, wherein when fluid pressure discharged from the discharge portion is not higher than a predetermined fluid pressure, the control mechanism is in a first state in which a flow of the working fluid from the discharge portion to the first control fluid chamber is restrained, and the working fluid in the first control fluid chamber is discharged to a low fluid pressure portion, and when the fluid pressure discharged from the discharge portion becomes higher than the predetermined fluid pressure, the control mechanism is in a second state in which the discharge portion and the first control fluid chamber are fluidly communicated, a flow of the working fluid from the first control fluid chamber to the low fluid pressure portion is restrained, and the working fluid in the second control fluid chamber is discharged into the low fluid pressure portion.

In a ninth aspect of the present invention, there is provided a variable displacement pump including:

a pump element constructed to be rotatably driven to introduce a working fluid from a suction portion into the pump element and discharge the working fluid from a discharge portion, the pump element being constructed such that as the pump element is rotated, volumes of a plurality of working fluid chambers are varied, a volume change mechanism including a moveable member, the volume change mechanism serving to vary an amount of volumetric change of each of the plurality of working fluid chambers opened to the discharge portion by movement of the moveable member, a biasing mechanism comprising two biasing members disposed with preloads, respectively, the biasing mechanism being constructed to bias the moveable member in a direction in which the amount of volumetric change of each of the plurality of working fluid chambers opened to the discharge portion is increased in accordance with a biasing force generated by the two biasing members, the biasing mechanism being constructed to stepwise increase the biasing force when the amount of volumetric change of each of the plurality of working fluid chambers opened to the discharge portion becomes not larger than a predetermined amount, a first control fluid chamber into which the working fluid discharged from the discharge portion is introduced, the first control fluid chamber serving to apply an urging force to the moveable member in accordance with an inside pressure thereof in a direction opposite to that of the biasing force of the biasing mechanism, a second control fluid chamber into which the working fluid discharged from the discharge portion is introduced through an orifice, the second control fluid chamber serving to apply an urging force to the moveable member in accordance with an inside pressure thereof in a same direction as a direction of the biasing force of the biasing mechanism, and a control mechanism serving to control movement of the moveable member, the control mechanism being operated before the amount of volumetric change of each of the plurality of working fluid chambers is reduced to a minimum by the volume change mechanism in accordance with fluid pressure discharged from the discharge portion, the control mechanism being operative to introduce the working fluid into the first control fluid chamber in accordance with increase in the fluid pressure discharged, and the control mechanism being operative to discharge the working fluid in the second control fluid chamber into a low fluid pressure portion in accordance with further increase in the fluid pressure discharged.

In a variable displacement pump of the present invention, when retention of a desired discharge fluid pressure is required, an increase in discharge fluid pressure can be suppressed to thereby possibly retain the discharge fluid pressure required even in a case where pump rotation speed is increased.

The other objects and features of this invention will become understood from the following description with reference to the accompanying drawings.

BRIEF DESCRIPTION OF THE DRAWINGS

FIG. 14A shows that an axial width of the first land is substantially equal to an opening width of the first control port. FIG. 14B shows that an axial width of the first land is larger than an opening width of the first control port. FIG. 14C shows that an opening width of the first control port is larger than an axial width of the first land.

FIG. 15A shows that an axial width of the first land is substantially equal to an opening width of the first control port. FIG. 15B shows that an axial width of the first land is larger than an opening width of the first control port. FIG. 15C shows that an opening width of the first control port is larger than an axial width of the first land.

DETAILED DESCRIPTION OF THE INVENTION

Figure 1:
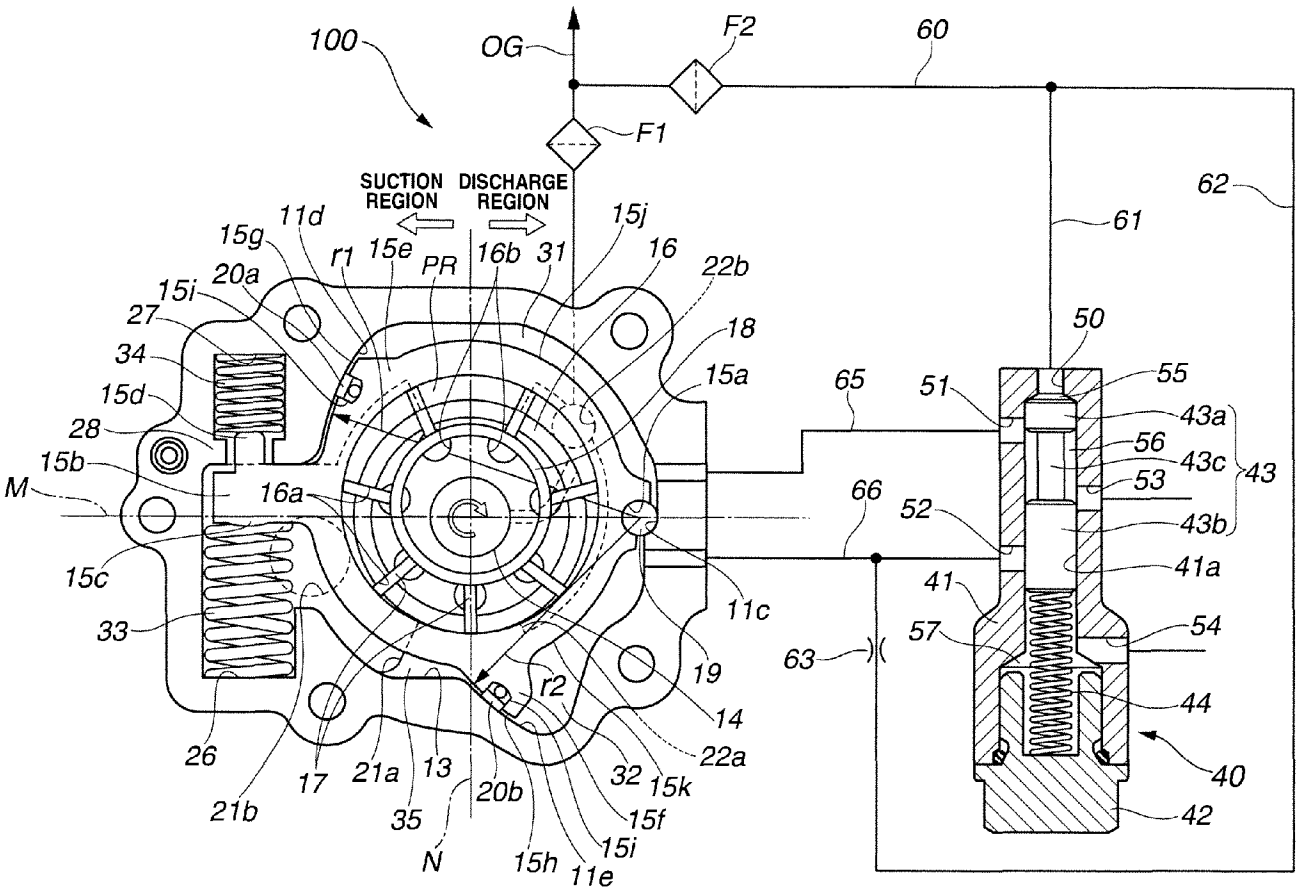
FIG. 1 is a schematic diagram of a variable displacement pump according to a first embodiment of the present invention, showing a construction of the variable displacement pump and a hydraulic circuit thereof.

In the following, a variable displacement pump according to each of embodiments of the present invention is explained by referring to FIGS. 1-15C. In the embodiments, the variable displacement pump is used as an oil pump that supplies a lubricating oil to sliding parts of an internal combustion engine for a vehicle or a valve timing control apparatus for open/closing timing control of an engine valve.

Referring to FIG. 1 to FIG. 9, there is shown variable displacement pump 100 according to a first embodiment of the present invention which is used as an oil pump disposed in a front end portion of a cylinder block (not shown) or a balancer (not shown) of the internal combustion engine. As shown in FIG. 1 to FIG. 4, variable displacement pump 100 includes a pump housing constituted of pump body 11 that is formed into a U-shape in vertical cross-section having one open end and includes pump accommodating chamber 13, and cover member 12 that closes the one open end of pump body 11. Drive shaft 14 is rotatably supported by the pump housing, and extends through a substantially central portion of pump accommodating chamber 13. Drive shaft 14 is driven to rotate about a rotation axis by a crankshaft (not shown) or a balancer shaft (not shown). Cam ring 15 as a moveable member is displaceably (swingably) disposed within pump accommodating chamber 13. Cam ring 15 constitutes a volume change mechanism that serves to vary an amount of volumetric change of a plurality of pump chambers (working fluid chambers) PR in cooperation with first and second control fluid chambers 31, 32 and a biasing mechanism as explained later. A pump element is accommodated in an inner peripheral side of cam ring 15, and is driven to rotate in a counterclockwise direction in FIG. 1 by drive shaft 14, thereby increasing and decreasing a volume of each of pump chambers PR as a working fluid chamber formed between the pump element and cam ring 15. The pump element thus performs a pumping function. Pilot valve 40 is provided on the pump housing (cover member 12). Pilot valve 40 is a control mechanism that serves to control swing movement of cam ring 15 by controlling introduction of discharge fluid pressure to each of control fluid chambers 31, 32 and discharge the discharge fluid pressure therefrom.

The pump element includes rotor 16 rotatably disposed on the inner peripheral side of cam ring 15. Rotor 16 is connected to an outer peripheral portion of drive shaft 14 at a central portion thereof, so that rotor 16 is rotatable about a rotation axis, i.e., the rotation axis of drive shaft 14. Further, the pump element includes a plurality of vanes 17 disposed on an outer peripheral portion of rotor 16 so as to be moveable in a radial direction of rotor 16, and a pair of ring members 18, 18 having a diameter smaller than rotor 16 and disposed on an inner peripheral side of rotor 16 at opposite axial end portions of rotor 16. A plurality of slits 16*a* are formed in the outer peripheral portion of rotor 16 such that vanes 17 are moveable to project from slits 16*a* and retreat thereinto, respectively.

Figure 2:
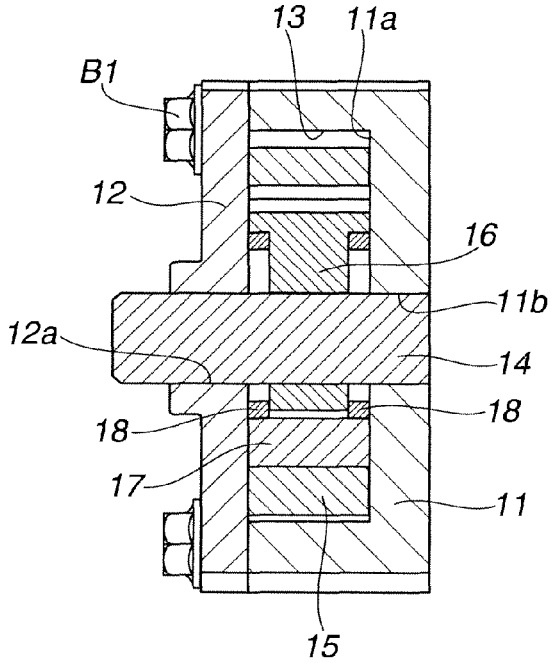
FIG. 2 is a vertical cross section of the variable displacement pump shown in FIG. 1.
Figure 3:
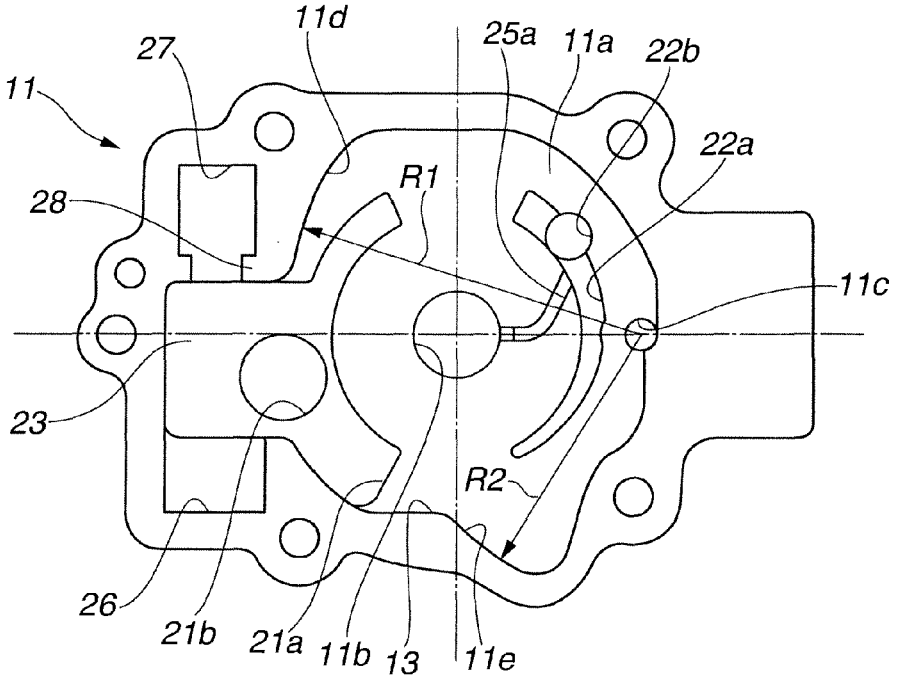
FIG. 3 is a plan view of a pump body of the variable displacement pump shown in FIG. 1 when viewed from a side of a mating surface of the pump body on which the pump body is mated with a cover member.
Figure 4:
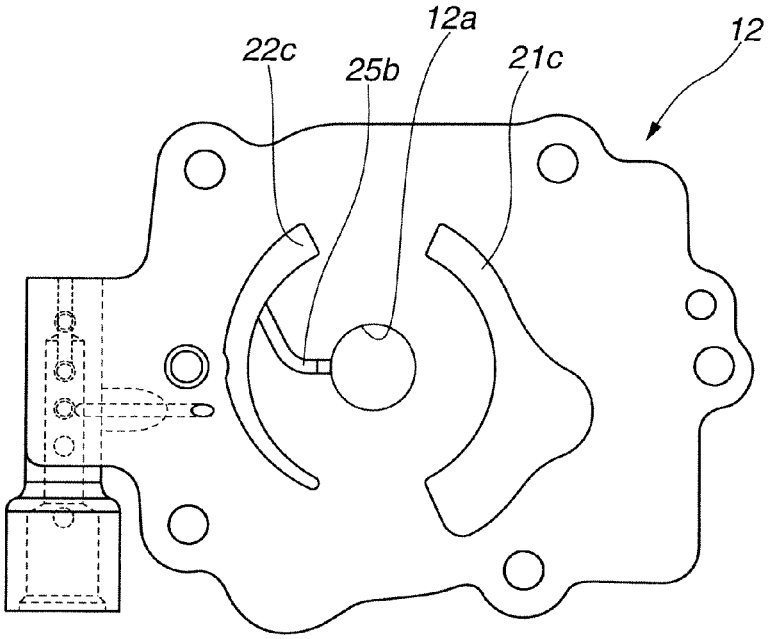
FIG. 4 is a plan view of the cover member when viewed from a side of a mating surface of the cover member on which the cover member is mated with the pump body.

Pump body 11 is integrally formed of an aluminum alloy material. As shown in FIG. 3 and FIG. 2, pump body 11 has end wall 11*a* disposed at one of opposite axial ends of cam ring 15. End wall 11*a* serves as one end wall of pump accommodating chamber 13, and bearing hole 11*b* formed in a substantially central position of end wall 11*a*. Bearing hole 11*b* extends through end wall 11*a* and supports one end portion of drive shaft 14. Support groove 11*c* having a generally semispherical shape in cross-section is formed in a predetermined position in an inner peripheral wall of pump accommodating chamber 13. Cam ring 15 is swingably supported in support groove 11*c* through bar-shaped pivot pin 19. Further, formed in the inner peripheral wall of pump accommodating chamber 13 is seal slide contact surface 11*d* that is slidably contacted with seal member 20*a* disposed in an outer peripheral portion of cam ring 15. Seal slide contact surface 11*d* is located on an upper-half side of pump body 11 as shown in FIG. 1 with respect to straight line M (hereinafter referred to as "a cam ring reference line M") that connects a center of bearing hole 11*b* and a center of support groove 11*c*. Seal slide contact surface 11*d* is formed as an arcuate surface that is located on a circle having a predetermined radius R1 around the center of support groove 11*c*. Seal slide contact surface 11*d* has such a circumferential length as to be always slidably contacted with seal member 20 within a range in which cam ring 15 is swingably moved in an eccentric relation to the rotation axis of rotor 16 (the rotation axis of drive shaft 14). Similarly, seal slide contact surface 11*e* is formed in the inner peripheral wall of pump accommodating chamber 13 and located on a lower-half side of pump body 11 as shown in FIG. 1 with respect to the cam ring reference line M. Seal slide contact surface 11*e* is slidably contacted with seal member 20*b* disposed in the outer peripheral portion of cam ring 15. Seal slide contact surface 11*e* is formed as an arcuate surface that is located on a circle having a predetermined radius R2 around the center of support groove 11*c*. Seal slide contact surface 11*e* has such a circumferential length as to be always slidably contacted with seal member 20*b* within a range in which cam ring 15 is eccentrically swingably moved.

As shown in FIG. 1 and FIG. 3, suction port 21*a* and discharge port 22*a* are formed in an inner surface of end wall 11*a* of pump body 11 on an outer peripheral side of bearing hole 11*b*. Each of suction port 21*a* and discharge port 22*a* is formed as a cutout portion. Suction port 21*a* is a suction portion that has a generally arcuate concave shape such that suction port 21*a* is opened into a region (hereinafter referred to as "a suction region") in which a volume of each of pump chambers PR is increased in accordance with the pumping function of the pump element. Discharge port 22*a* is a discharge portion that has a generally arcuate concave shape such that discharge port 22*a* is opened into a region (hereinafter referred to as "a discharge region") in which the volume of each of pump chambers PR is decreased in accordance with the pumping function of the pump element. Suction port 21*a* and discharge port 22*a* are substantially opposed to each other such that bearing hole 11*b* is disposed between suction port 21*a* and discharge port 22*a*.

As shown in FIG. 3, suction port 21*a* includes introduction portion 23 formed in a substantially intermediate position in a circumferential direction of suction port 21*a*. Introduction portion 23 extends to project toward a side of first spring accommodating chamber 26 as explained later, and is integrally formed with suction port 21*a*. Disposed in the vicinity of a boundary between introduction portion 23 and suction port 21*a* is inlet 21*b* that extends to be opened to an outside through end wall 11*a* of pump body 11. With this construction, a lubricating oil reserved in an oil pan (not shown) is sucked into each of pump chambers PR within the suction region through inlet 21*b* and suction port 21*a* owing to a negative pressure that is generated by the pumping function of the pump element. Suction port 21*a* and introduction portion 23 are communicated with low fluid pressure chamber 35 formed along an outer peripheral side of cam ring 15 in the suction region. With the communication, a suction pressure, that is, the oil having a low fluid pressure is introduced into low fluid pressure chamber 35.

Discharge port 22*a* has outlet 22*b* in an initial end portion thereof which extends to be opened to an outside through end wall 11*a* of pump body 11. With this construction, an oil pressurized by the pumping function of the pump element and discharged into discharge port 22*a* is supplied from outlet 22*b* to each of slide parts and a valve timing control apparatus (both not shown) in the engine through main oil gallery OG formed in the cylinder block.

Discharge port 22*a* is communicated with bearing hole 11*b* through communication groove 25*a* that is a cutout formed in end wall 11*a* of pump body 11. The oil is supplied to bearing hole 11*b* and supplied to rotor 16 and side portions of each of vanes 17 through communication groove 25*a*, so that good lubrication in each of slide parts thereof can be ensured. Communication groove 25*a* is formed so as to extend in a direction that is not aligned with a direction in which each of vanes 17 is projected from slit 16*a* and retreated thereinto. With this construction, each of vanes 17 can be prevented from falling into communication groove 25*a* upon being projected from slit 16*a* and retreated thereinto.

Cover member 12 is formed into a generally plate shape as shown in FIG. 2. Cover member 12 is disposed at the other of the opposite axial ends of cam ring 15. Cover member 12 is fixed to a surface of the open end of pump body 11 by means of a plurality of bolts B1. Cover member 12 has bearing hole 12*a* opposed to bearing hole 11*b* of pump body 11. Bearing hole 12*a* extends through cover member 12, in which the other end of drive shaft 14 is rotatably supported. Similarly to pump body 11, cover member 12 has suction port 21*c*, discharge port 22*c* and communication groove 25*b* on an inner surface thereof which is opposed to pump body 11. Suction port 21*c*, discharge port 22*c* and communication groove 25*b* are arranged in opposed relation to suction port 21*a*, discharge port 22*a* and communication groove 25*a* of pump body 11, respectively.

Drive shaft 14 extends through end wall 11*a* of pump body 11, and has one axial end exposed to an outside and connected to the crankshaft (not shown) or the like. Drive shaft 14 receives a rotational force transmitted from the crankshaft or the like, thereby rotating rotor 16 in a clockwise direction in FIG. 1. As shown in FIG. 1, straight line N (hereinafter referred to as "a cam ring eccentric direction line N") which extends across the rotation axis of drive shaft 14 and intersects with the cam ring reference line M denotes a boundary between a suction region and a discharge region.

Rotor 16 has a plurality of slots 16*a* that extend from a central side of rotor 16 toward a radial outside of rotor 16 and are disposed in a circumferential direction of rotor 16 at intervals. Back pressure chamber 16*b* having a generally circular section is formed on a radial inner end of each of slots 16*a*, into which the discharged oil is introduced. Each of vanes 17 is urged to move outward from each of slots 16*a* by a centrifugal force generated in accordance with rotation of rotor 16 and an oil pressure within back pressure chamber 16*b*.

During rotation of rotor 16, a tip end surface of each of vanes 17 is allowed to slide on an inner peripheral surface of cam ring 15, and a root end surface thereof is allowed to slide on an outer peripheral surface of each of ring members 18, 18. That is, each of vanes 17 is pushed in a radially outward direction of rotor 16 by each of ring members 18, 18. Even in a case where engine rotation speed is low and the centrifugal force and the oil pressure within back pressure chamber 16*b* are small, a tip end of each of vanes 17 is allowed to slide on the inner peripheral surface of cam ring 15 and thereby define each of pump chambers PR with fluid-tightness.

Cam ring 15 is made of so-called sintered metal and formed into a generally cylindrical shape having a circular section. An axis extending through a center of a circular inner circumference of the circular section will be hereinafter referred to as "a central axis of cam ring 15". Cam ring 15 is swingably moved such that an eccentric amount of the central axis of cam ring 15 with respect to the rotation axis of rotor 16 (i.e., the rotation axis of drive shaft 14) is varied. Pivot portion 15*a* is formed in a predetermined position of an outer periphery of cam ring 15. Pivot portion 15*a* is a grooved portion that extends in an axial direction of cam ring 15 and has a generally arcuate shape in section. Pivot portion 15*a* is engaged with pivot pin 19, thereby constituting an eccentric swing fulcrum for cam ring 15. Arm portion 15*b* is formed to be diametrically opposed to pivot portion 15*a* with respect to the central axis of cam ring 15, and extends along a radial direction of cam ring 15. Arm portion 15*b* is connected with first spring 33 having a predetermined spring constant on one side thereof, and is connected with second spring 34 having a predetermined spring constant smaller than that of first spring 33 on the other side thereof. Pressing projection 15*c* having a generally arcuate shaped section is formed on one side of arm portion 15*b* in a movement (rotation) direction of arm portion 15*b* (i.e., on a side of first spring 33). Pressing projection 15*d* is formed on the other side of arm portion 15*b* in the displacement (rotation) direction of arm portion 15*b* (i.e., on a side of second spring 34). Pressing projection 15*d* has a length longer than a width (thickness) of arm displacement restricting portion 28 formed in pump body 11 as explained later. Pressing projection 15*c* is always contacted with one end of first spring 33, and pressing projection 15*d* is always contacted with one end of second spring 34. Thus, arm portion 15*b* is connected with first and second springs 33, 34.

As shown in FIG. 1 and FIG. 3, pump body 11 also includes first and second spring accommodating chambers 26, 27 disposed in a position spaced from bearing hole 11*b* in a radially outward direction of bearing hole 11*b*. First and second spring accommodating chambers 26, 27 in which first and second springs 33, 34 are accommodated, respectively, are arranged adjacent to pump accommodating chamber 13 along the cam ring eccentric direction line N as shown in FIG. 1. First spring 33 is elastically installed between an end wall of first spring accommodating chamber 26 and arm portion 15*b* (pressing projection 15*c*) with predetermined preload W1. On the other hand, second spring 34 is elastically installed between an end wall of second spring accommodating chamber 27 and arm portion 15*b* (pressing projection 15*d*) with predetermined preload W2. Second spring 34 has a wire diameter smaller than that of first spring 33 and an outer coil diameter smaller than that of first spring 33. Arm displacement restricting portion 28 is disposed between first spring chamber 26 and second spring chamber 27 such that a step is formed between first and second spring accommodating chambers 26, 27. One side of arm displacement restricting portion 28 is brought into contact with the other side of arm portion 15*b*, thereby restricting rotational displacement of arm portion 15*b* in the clockwise direction in FIG. 1. The other side of arm displacement restricting portion 28 is brought into contact with the one end of second spring 34, thereby restricting a maximum amount of extension of second spring 34.

Thus, cam ring 15 is always urged in a direction in which the eccentric amount of the central axis of cam ring 15 is increased (hereinafter referred to as "an eccentric direction") as shown in the clockwise direction in FIG. 1 through arm portion 15*b* by resultant force W0 of the preloads W1, W2 of first and second springs 33, 34, i.e., a biasing force of first spring 33 generating a relatively large spring load. As a result, as shown in FIG. 1, when cam ring 15 is in a non-operated state, pressing projection 15*d* of arm portion 15*b* is located in second spring accommodating chamber 27 and presses second spring 34 into a compressed state and the other side of arm portion 15*b* is pressed onto the one side of arm displacement restricting portion 28. As a result, swing movement of cam ring 15 is restricted in a position in which the eccentric amount of the central axis of cam ring 15 is a maximum.

Cam ring 15 also includes first and second seal portions 15*e*, 15*f* that project from the outer periphery of cam ring 15. First and second seal portions 15*e*, 15*f* have first and second seal surfaces 15*g*, 15*h* that face first and second seal slide surfaces 11*d*, 11*e* located on the inner peripheral wall of pump accommodating chamber 13. First and second seal surfaces 15*g*, 15*h* are formed concentrically with first and second seal slide surfaces 11*d*, 11*e*. First and second seal surfaces 15*g*, 15*h* are formed with seal retaining grooves 15*i*, respectively, which extend along the axial direction of cam ring 15. First and second seal members 20*a*, 20*b* are supported in seal retaining grooves 15*i* to slide on first and second seal slide surfaces 11*d*, 11*e*, respectively, during the eccentric swing movement of cam ring 15.

Specifically, first and second seal surfaces 15*g*, 15*h* have predetermined radiuses r1, r2 slightly smaller than radiuses R1, R2 of the corresponding seal slide surfaces 11*d*, 11*e*, so that predetermined fine clearances are formed therebetween. Each of first and second seal members 20*a*, 20*b* are formed of a fluorine-based resin having low frictional properties, and has a straight strap shape linearly extending along the axial direction of cam ring 15. First and second seal members 20*a*, 20*b* are pressed onto the corresponding seal slide surfaces 11*d*, 11*e* by an elastic force of elastic members made of rubber and disposed at bottoms of seal retaining grooves 15*i*. As a result, the fine clearances between first and second seal surfaces 15*g*, 15*h* and the corresponding seal slide surfaces 11*d*, 11*e* are sealed with fluid-tightness.

First and second control fluid chambers 31, 32 are defined between an outer peripheral surface of cam ring 15 and the inner peripheral wall of pump accommodating chamber 13 by pivot pin 19 and first and second seal members 20*a*, 20*b*. A fluid pressure in the engine which corresponds to a pump discharge fluid pressure is introduced into first and second control fluid chambers 31, 32 through control pressure introducing passage 60 branched from main oil gallery OG. Specifically, the pump discharge fluid pressure is supplied to first control fluid chamber 31 through first introduction passage 61 that is one of two branch passages of control pressure introducing passage 60, pilot valve 40 disposed in first introduction passage 61, and first supply-discharge passage 65. The discharge fluid pressure is also supplied to second control fluid chamber 32 through second introduction passage 62 that is the other of two branch passages of control pressure introducing passage 60, predetermined orifice 63 disposed in second introduction passage 62, and second supply-discharge passage 66. In FIG. 1, reference signs F1, F2 denote oil filters each being formed of, for instance, filter paper.

The fluid pressures as described above are exerted on pressure receiving surfaces 15*j*, 15*k* as parts of the outer peripheral surface of cam ring 15 which face first and second control fluid chambers 31, 32, respectively. Owing to the exertion of the fluid pressures, a swing force to swing cam ring 15 (a displacement force to displace cam ring 15) is applied to cam ring 15. First pressure receiving surface 15*j* is larger than second pressure receiving surface 15*k*. With this construction, in a case where same fluid pressure is exerted on first and second pressure receiving surfaces 15*j*, 15*k*, cam ring 15 can be biased in a direction in which the eccentric amount of the central axis of cam ring 15 is reduced (hereinafter referred to as "a concentric direction") as shown in a counterclockwise direction in FIG. 1. In other words, first and second control fluid chambers 31, 32 serve to control the displacement amount of cam ring 15 in the concentric direction by biasing cam ring 15 in the concentric direction through pressure receiving surfaces 15*j*, 15*k* by inside pressures of first and second control fluid chambers 31, 32 which are exerted on pressure receiving surfaces 15*j*, 15*k* in directions opposite to each other.

In thus-constructed oil pump 100 according to the first embodiment, the biasing force acting on cam ring 15 in the eccentric direction in accordance with the spring load of first spring 33, and the biasing force acting on cam ring 15 in the concentric direction in accordance with the spring load of second spring 34 and the inside pressures of control fluid chambers 31, 32 are balanced with each other in a predetermined relationship therebetween. In a case where the urging force acting on cam ring 15 in accordance with the inside pressures of control fluid chambers 31, 32 is smaller than the resultant force W0 of preload W1 of first spring 33 and preload W2 of second spring 34 which is a difference between preload W1 and preload W2 (i.e., W0=W1−W2), cam ring 15 is in a maximum eccentric state as shown in FIG. 1. In contrast, in a case where the urging force acting on cam ring 15 in accordance with the inside pressures in control fluid chambers 31, 32 becomes larger than the resultant force W0 of preload W1 of first spring 33 and preload W2 of second spring 34 as the discharge fluid pressure is increased, cam ring 15 is displaced in the concentric direction.

Figure 5:
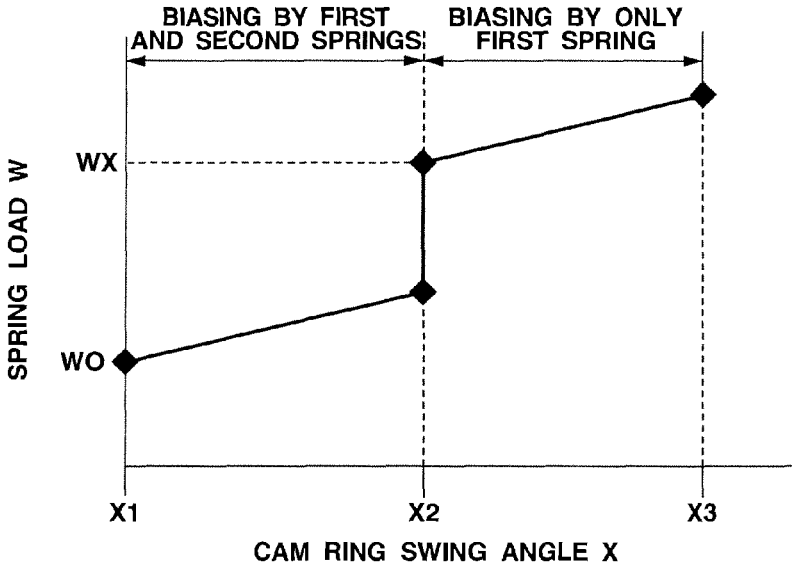
FIG. 5 is a graph illustrating a relationship between spring load of two springs and a swing angle of a cam ring as shown in FIG. 1.

A relationship between spring load W of first and second springs 33, 34 and swing angle (displacement amount) X of cam ring 15 is explained in detail by referring to FIG. 5. As shown in FIG. 5, at angular position X1 at which cam ring 15 is in the maximum eccentric state, when the urging force acting on cam ring 15 in accordance with the inside pressures in control fluid chambers 31, 32 becomes equal to the resultant force W0 of preload W1 of first spring 33 and preload W2 of second spring 34 which corresponds town urging force acting on cam ring 15 in accordance with first changeover fluid pressure Pf as explained later, first spring 33 begins to be compressed and second spring 34 begins to be extended, so that cam ring 15 is displaced in the concentric direction. After that, as the discharge fluid pressure is increased, the urging force acting on cam ring 15 in accordance with the inside pressures of control fluid chambers 31, 32 becomes large such that second spring 34 is contacted with arm displacement restricting portion 28. Owing to the contact of second spring 34 with arm displacement restricting portion 28, assistance of second spring 34 is eliminated, so that displacement of cam ring 15 in the concentric direction is interrupted (see angular position X2 in FIG. 5). When the discharge fluid pressure is further increased such that the urging force acting on cam ring 15 in accordance with the inside pressures of control fluid chambers 31, 32 becomes equal to spring load Wx of first spring 33 which corresponds to an urging force acting on cam ring 15 in accordance with second changeover fluid pressure Ps as explained later, first spring 33 is further compressed so that cam ring 15 is further displaced in the concentric direction (see angular position X3 in FIG. 5).

Referring back to FIG. 1, pilot valve 40 is now explained. As shown in FIG. 1, pilot valve 40 includes stepped tube-shaped valve body 41 having a small diameter portion on a side of one axial end thereof and a large diameter portion on a side of the other axial end thereof, plug 42 closing an open end formed on the side of the other axial end of the valve body 41, spool 43 disposed within valve body 41 so as to be slidable in an axial direction of valve body 41, and valve spring (control spring) 44 disposed within valve body 41 on the side of the other axial end thereof so as to always bias spool 43 toward the one axial end of valve body 41. Valve body 41 may be formed integrally with cover member 12, but arrangement of valve body 41 in cover member 12 is not particularly limited. Specifically, spool 43 includes first and second lands 43*a*, 43*b* that are a pair of large diameter portions coming into slide-contact with an inner peripheral surface of valve body 41, and serves to control supply of fluid pressure to second control fluid chamber 32 and discharge of fluid pressure therefrom. Valve spring 44 is installed between plug 42 and spool 43 with predetermined preload Wk.

Valve body 41 includes valve accommodating portion 41*a* in which spool 43 is accommodated. Valve accommodating portion 41*a* has an inner diameter substantially same as an outer diameter of spool 43 (i.e., an outer diameter of each of lands 43*a*, 43*b*). Valve accommodating portion 41*a* extends in an axial range of valve body 41 which excludes opposite axial end portions of valve body 41. Valve body 41 also includes introduction port 50 formed in one end portion of the small diameter portion which is located on the one axial end of valve body 41. Introduction port 50 is opened to an end surface of the small diameter portion and connected with first introduction passage 61. Introduction port 50 is also opened to fluid fluid pressure chamber 55 defined in valve accommodating portion 41*a* as explained later. Introduction port 50 has a diameter smaller than the inner diameter of valve accommodating portion 41*a*. Valve body 41 also includes a threaded hole formed in the large diameter portion of valve body 41. The threaded hole has a diameter larger than the inner diameter of valve accommodating portion 41*a*, into which plug 42 is screwed.

Valve body 41 also includes first control port 51, second control port 52, first drain port 53 and second drain port 54. These ports 51, 52, 53 and 54 extend through a peripheral wall of valve body 41 which defines valve accommodating portion 41*a*. First control port 51 is connected to first control fluid chamber 31 through first supply-discharge passage 65 at one end thereof, and can be communicated with introduction port 50 or first drain port 53 at the other end thereof as explained later. Second control port 52 is connected to second control fluid chamber 32 through second supply-discharge passage 66 at one end thereof, and can be communicated with first drain port 53 at the other end thereof as explained later. First drain port 53 is connected with a suction side or a low fluid pressure portion such as an oil pan (not shown) at one end thereof, and can be communicated with first and second control ports 51, 52 at the other end thereof to serve for discharging the oil in first and second control fluid chambers 31, 32 as explained later. Second drain port 54 is connected with the low fluid pressure portion at one end thereof, and connected with back pressure chamber 57 at the other end thereof to serve for discharging the oil in back pressure chamber 57 as explained later.

Spool 43 has first and second lands 43*a*, 43*b* on opposite end portions thereof in an axial direction of spool 43, and shank 43*c* between first and second lands 43*a*, 43*b*. First and second lands 43*a*, 43*b* are large diameter portions, and shank 43*c* is a small diameter portion having a diameter smaller than the diameter of first and second lands 43*a*, 43*b*. Spool 43 cooperates with valve body 41 to define fluid pressure chamber 55 in valve accommodating portion 41*a* between first land 43*a* and introduction port 50. Fluid pressure chamber 55 is communicated with introduction port 50 so that the pump discharge fluid pressure is introduced from introduction port 50 into fluid pressure chamber 55 through first introduction passage 61. Spool 43 also cooperates with valve body 41 to define intermediate chamber 56 disposed in valve accommodating portion 41*a* between first and second lands 43*a*, 43*b* and shank 43*c*. First control port 51 and first drain port 53, or second control port 52 and first drain port 53 are communicated with each other through intermediate chamber 56 depending upon a position of spool 43 within valve accommodating portion 41*a* in an axial direction of valve body 41. Spool 43 also cooperates with valve body 41 and plug 42 to define back pressure chamber 57 disposed in valve accommodating portion 41*a* between to second land 43*b* and plug 42. Second drain port 54 is communicated with back pressure chamber 57, so that the oil leaked from intermediate chamber 56 through a fine clearance between an outer peripheral surface of second land 43*b* and an inner peripheral surface of valve accommodating portion 41*a* is introduced into back pressure chamber 57 and then drained from second drain port 54.

Figure 9:
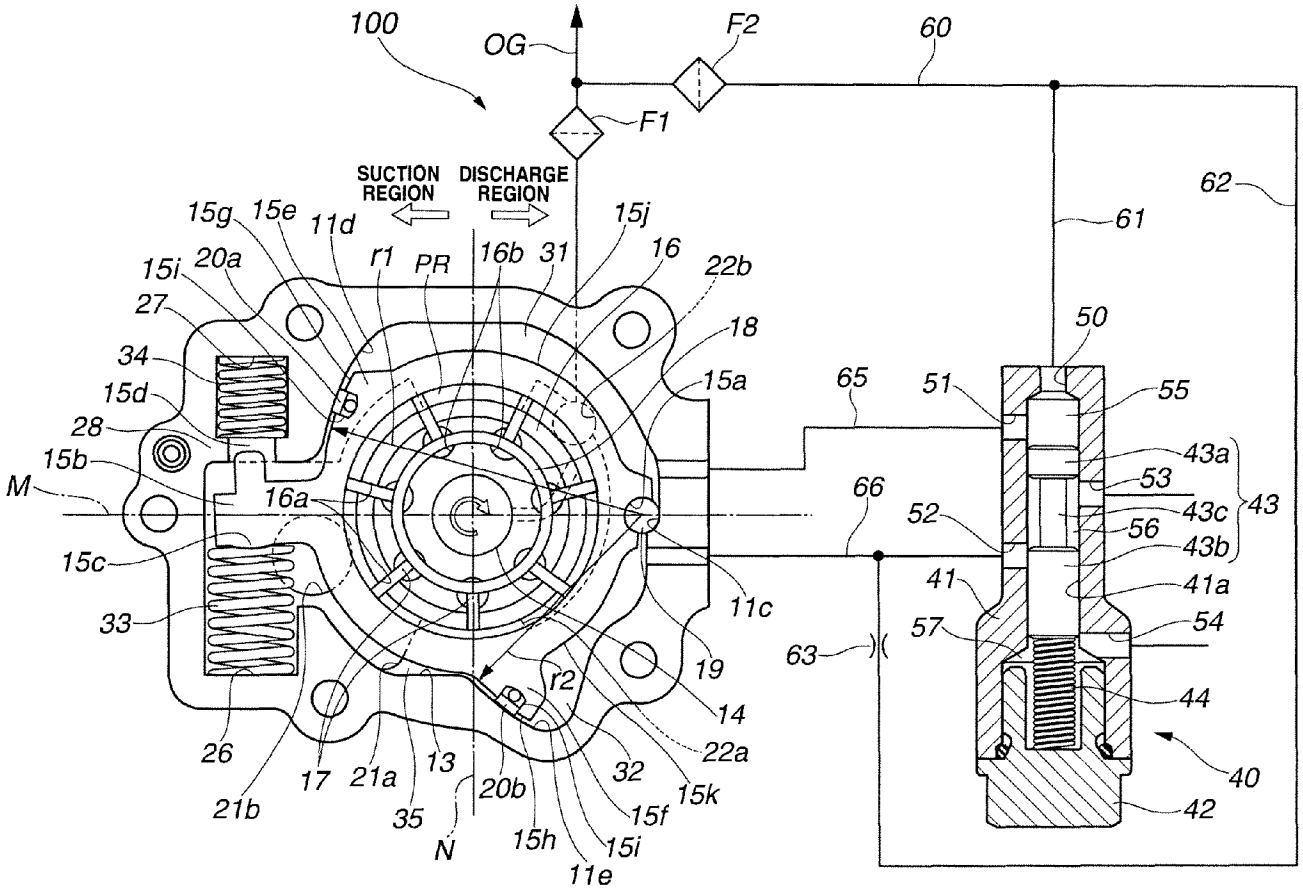
FIG. 9 is a diagram similar to FIG. 1, showing a condition of the variable displacement pump according to the first embodiment which corresponds to range "d" shown in FIG. 6.

Thus constructed pilot valve 40 is shiftable between a first state as shown in FIG. 1 and a second state as shown in FIG. 9 in response to the discharge fluid pressure. When the discharge fluid pressure introduced from introduction port 50 into fluid pressure chamber 55 is not higher than a predetermined fluid pressure (first changeover fluid pressure Pf), pilot valve 40 is in the first state. In the first state, spool 43 is urged to move toward the one axial end of valve body 41 (i.e., toward the side of introduction port 50) to a maximum extent to thereby be in an initial position in which first land 43*a* of spool 43 is abutted against one axial end wall of valve accommodating portion 41*a* (a tapered end wall defining a part of fluid pressure chamber 55) by the biasing force of valve spring 44 based on the preload Wk. In the initial position, fluid communication between introduction port 50 and other ports 51-54 is interrupted by first land 43*a*, and fluid communication between first control port 51 and first drain port 53 is established through intermediate chamber 56. On the other hand, fluid communication between second control port 52 and other ports 50, 51, 53, 54 is interrupted by second land 43*b*. A region of valve accommodating portion 41*a* in which spool 43 is in the initial position will be hereinafter referred to as "a first region". Owing to the above interruption and establishment of the fluid communication, the oil in first control fluid chamber 31 is discharged from first drain port 53 through first supply-discharge passage 65 and first control port 51, and the discharge fluid pressure is supplied to only second control fluid chamber 32 through second introduction passage 62. The term "interrupt" used in the above description relating to pilot valve 40 does not mean that fluid communication between the ports is completely blocked, but means that fluid communication between the ports is substantially restrained while a slight amount of the oil flows through the fine clearance formed on an outer peripheral side of each of lands 43*a*, 43*b* (hereinafter defined in the same way).

Figure 7:
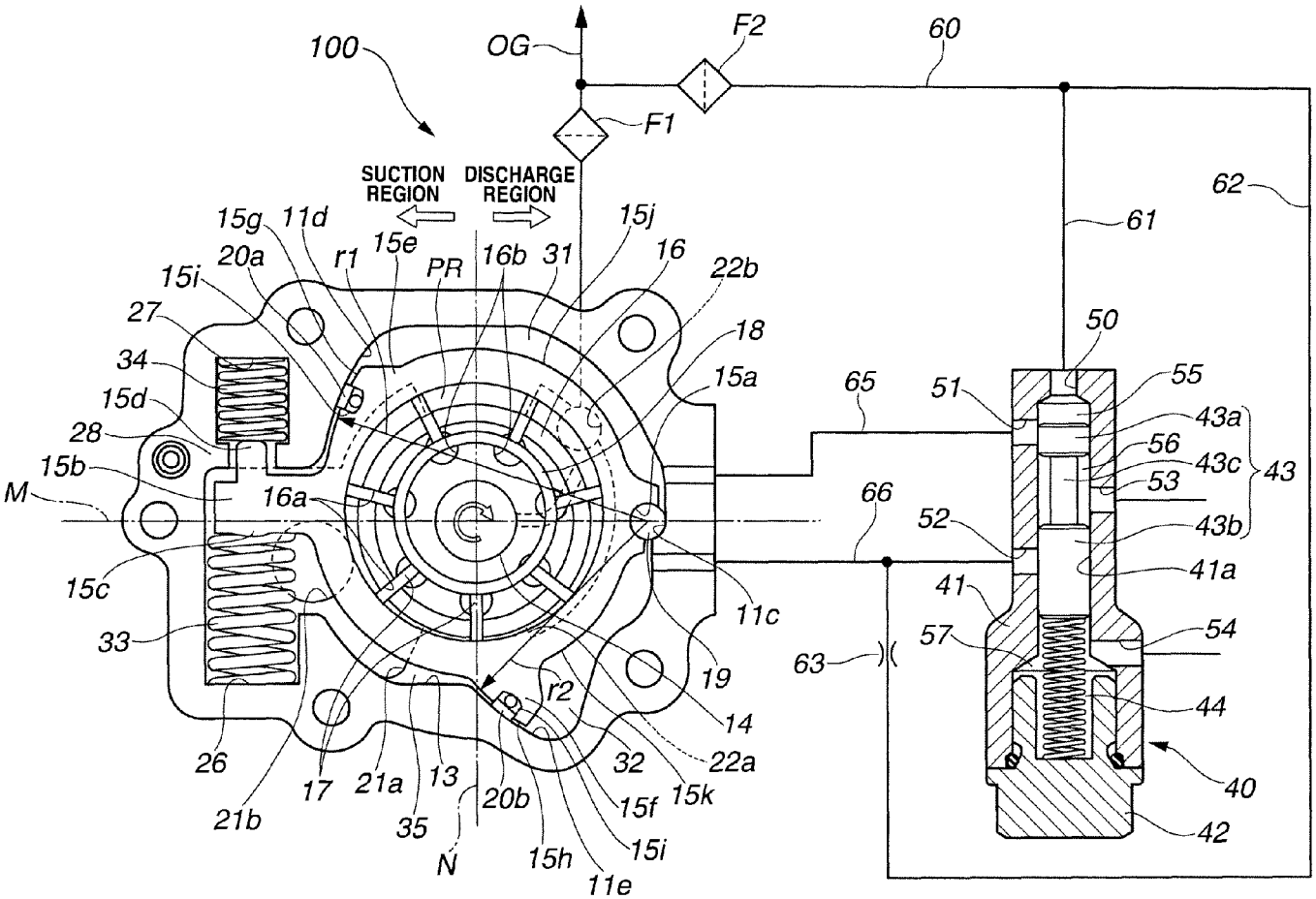
FIG. 7 is a diagram similar to FIG. 1, showing a condition of the variable displacement pump according to the first embodiment which corresponds to range "b" shown in FIG. 6.
Figure 8:
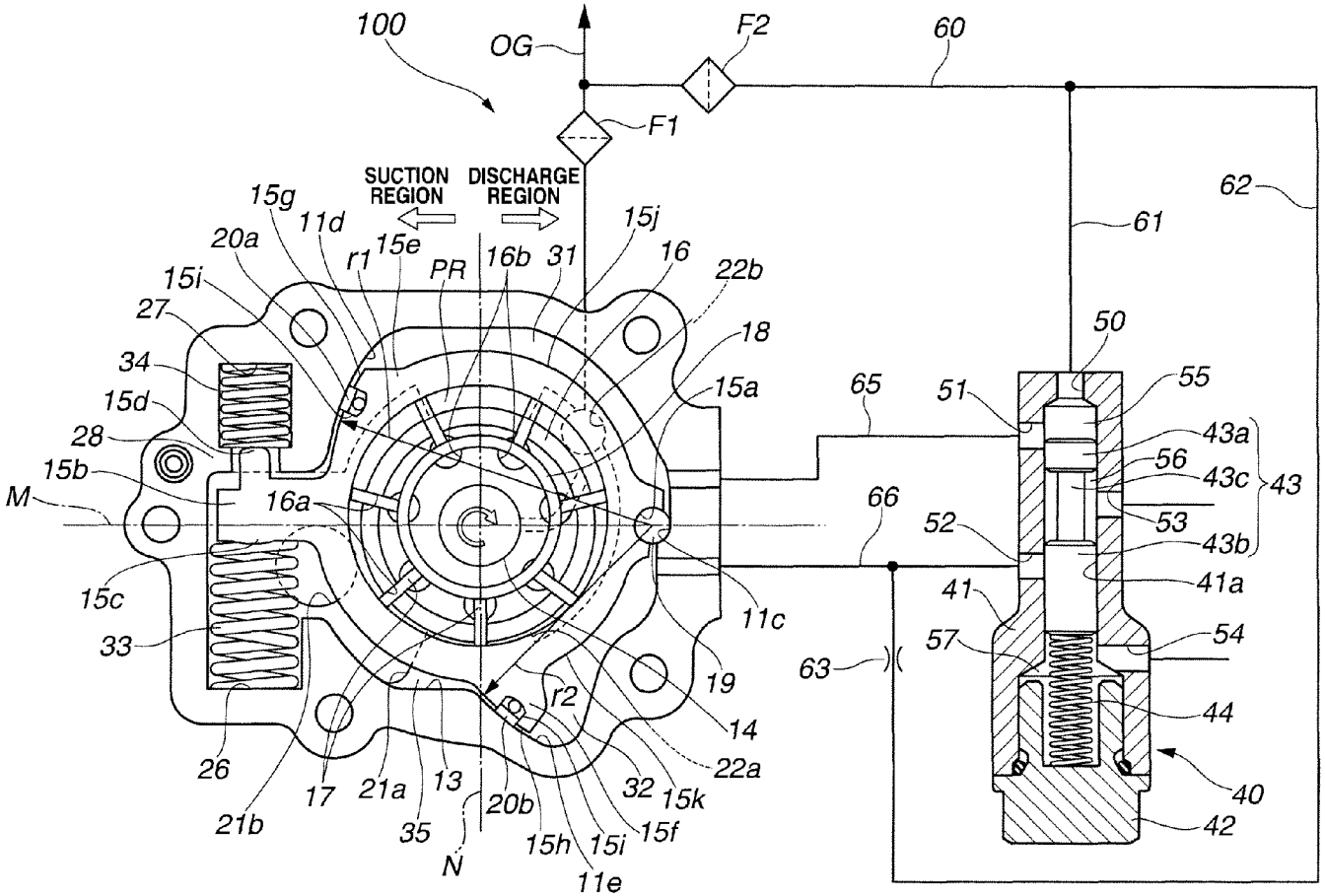
FIG. 8 is a diagram similar to FIG. 1, showing a condition of the variable displacement pump according to the first embodiment which corresponds to range "c" shown in FIG. 6.

When the discharge fluid pressure introduced into fluid pressure chamber 55 exceeds the predetermined fluid pressure, pilot valve 40 is shifted to the second state as shown in FIG. 9 in which spool 43 is urged to move toward the other axial end of valve body 41 to be in an operating position. That is, spool 43 is urged to move toward plug 42 against the biasing force of valve spring 44. More specifically, when the discharge fluid pressure is higher than the predetermined fluid pressure, i.e., the first changeover fluid pressure Pf and not higher than second changeover fluid pressure Ps, spool 43 is located in a second region as an intermediate region as shown in FIG. 7 and FIG. 8. In the second region, fluid communication between introduction port 50 and first control port 51 through fluid pressure chamber 55 is allowed, and fluid communication between first control port 51 and first drain port 53 is interrupted by first land 43*a*. On the other hand, interruption of the fluid communication between second control port 52 and other ports 50, 51, 53, 54 is kept by second land 43*b*. As a result, the discharge fluid pressure is supplied to first control fluid chamber 31 through first introduction passage 61 and pilot valve 40, and also supplied to second control fluid chamber 32 through second introduction passage 62. When the discharge fluid pressure exceeds the second changeover fluid pressure Ps, pilot valve 40 is brought into the second state in which spool 43 is in a third region in which spool 43 is approximated closer to plug 42 (see FIG. 9). In the third region, the fluid communication between introduction port 50 and first control port 51 is kept, and fluid communication between second control port 52 and first drain port 53 through intermediate chamber 56 is allowed. As a result, the oil in second control fluid chamber 32 is discharged from second control fluid chamber 32, and the discharge fluid pressure is supplied to only first control fluid chamber 31.

An operation of variable displacement pump 100 according to the first embodiment of the present invention will be explained hereinafter by referring to FIG. 1 and FIG. 6 to FIG. 9.

Figure 6:
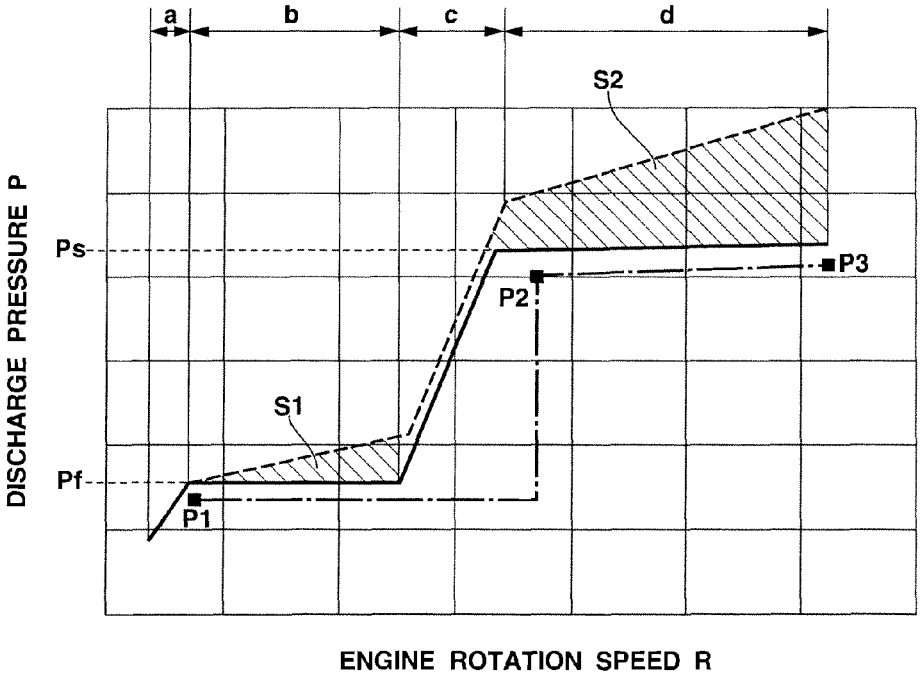
FIG. 6 is a graph illustrating a fluid pressure characteristic of the variable displacement pump according to the first embodiment.

Firstly, a necessary fluid pressure in an internal combustion engine which is a reference for control of discharge fluid pressure of variable displacement pump 100, is explained by referring to FIG. 6. Point P1 shown in FIG. 6 denotes first fluid pressure required by the engine which corresponds to fluid pressure required by a valve timing control apparatus used in the vehicle which serves to enhance fuel economy. Point P2 shown in FIG. 6 denotes second fluid pressure required by the engine which corresponds to fluid pressure required by an oil jet device used in the vehicle which serves to cool a piston of the engine and a drive source of a variable valve operating apparatus. Point sign P3 shown in FIG. 6 denotes third fluid pressure required by the engine for lubricating a bearing portion of the crankshaft upon high speed rotation of the engine. Dashed line shown in FIG. 6 which connects these points P1, P2 and P3 denotes ideal necessary fluid pressure (discharge fluid pressure) P in the internal combustion engine according to engine rotation speed R. Solid line shown in FIG. 6 denotes fluid pressure characteristic of variable displacement pump 100, and broken line shown in FIG. 6 denotes fluid pressure characteristic of the above-described conventional pump.

In addition, reference sign Pf shown in FIG. 6 denotes the first changeover fluid pressure at which spool 43 is started to move from the first region to the second region against the biasing force Wk of valve spring 44. Reference sign Ps shown in FIG. 6 denotes the second changeover fluid pressure at which spool 43 is started to move from the second region to the third region against the biasing force Wk of valve spring 44. Further, in variable displacement pump 100, the spring loads of first and second springs 33, 34 and areas of pressure receiving surfaces 15*j*, 15*k* of control fluid chambers 31, 32 are set such that a working fluid pressure (first working fluid pressure) applied to cam ring 15 on which the biasing forces W1, W2 of first and second springs 33, 34 are exerted as shown in FIG. 1 is lower than the first changeover fluid pressure Pf, and a working fluid pressure (second working fluid pressure) applied to cam ring 15 on which only the biasing force W1 of first spring 33 is exerted as shown in FIG. 9 is higher than the second changeover fluid pressure Ps.

By thus setting the spring loads of first and second springs 33, 34 and the areas of pressure receiving surfaces 15*j*, 15*k*, in variable displacement pump 100, the discharge fluid pressure (fluid pressure in the engine) P is lower than the first changeover fluid pressure Pf in section "a" shown in FIG. 6 which corresponds to a rotation speed range from engine start to a low rotation speed range. Therefore, as shown in FIG. 1, pilot valve 40 is in the first state, that is, spool 43 is in the first region in which fluid communication between introduction port 50 and other ports 51-54 is interrupted by first land 43*a*, fluid communication between first control port 51 and first drain port 53 through intermediate chamber 56 is allowed, and fluid communication between second control port 52 and other ports 50, 51, 53, 54 is interrupted by second land 43*b*. Accordingly, the oil in first control fluid chamber 31 is discharged into the low fluid pressure portion, and the discharge fluid pressure P is supplied to only second control fluid chamber 32 through second introduction passage 62. Cam ring 15 is held in the maximum eccentric state in which arm portion 15 is contacted with arm displacement restricting portion 28 by the urging force generated by the inside pressure of second control fluid chamber 32 and the biasing force generated by the resultant force W0 of the biasing forces of first and second springs 33, 34, that is, by the spring load of first spring 33 which is larger than that of second spring 34. As a result, the amount of the oil discharged by the pump becomes largest, and the discharge fluid pressure P has such a characteristic that the discharge fluid pressure P is increased substantially in proportion to increase in engine rotation speed R.

After that, when the discharge fluid pressure P has reached the first changeover fluid pressure Pf in accordance with increase in engine rotation speed R as shown in FIG. 6, spool 43 of pilot valve 40 is moved toward plug 42 against the biasing force Wk of valve spring 44 as shown in FIG. 7 so that spool 43 is shifted from the first region to the second region. In the second region, fluid communication between introduction port 50 and first control port 51 through fluid pressure chamber 55 is allowed, and fluid communication between first control port 51 and first drain port 53 is interrupted by first land 43*a*. On the other hand, fluid communication between second control port 52 and other ports 50, 51, 53, 54 is kept interrupted by second land 43*b*. Accordingly, the discharge fluid pressure starts to be supplied to first control fluid chamber 31 through first introduction passage 61, and the discharge fluid pressure is kept supplied to second control fluid chamber 32. As a result, the resultant force of the urging force generated by the inside pressure of first control fluid chamber 31 and the biasing force W2 of second spring 34 overcomes the resultant force of the biasing force W1 of first spring 33 and the urging force generated by the inside pressure of second control fluid chamber 32, so that cam ring 15 is started to move in the concentric direction.

Then, the discharge fluid pressure P is lowered due to reduction of the eccentric amount of the central axis of cam ring 15 which is caused by displacement of cam ring 15 in the concentric direction. The urging force generated by the discharge fluid pressure P lowered becomes smaller than the biasing force Wk of valve spring 44. As a result, spool 43 is urged to move from the second region back to the first region by the biasing force Wk of valve spring 44. In the first region, fluid communication between first control port 51 and introduction port 50 through fluid pressure chamber 55 is interrupted by first land 43*a* of spool 43 and fluid communication between first control port 51 and first drain port 53 through intermediate chamber 56 is allowed again. As a result, the oil in first control fluid chamber 31 is discharged, so that the inside pressure of first control fluid chamber 31 is lowered. The resultant force of the urging force generated by the inside pressure of first control fluid chamber 31 and the biasing force W2 of second spring 34 becomes smaller than the resultant force of the urging force generated by the inside pressure of second control fluid chamber 32 and the biasing force W1 of first spring 33, so that cam ring 15 is brought into the maximum eccentric state as shown in FIG. 1 again. In the maximum eccentric state, the discharge fluid pressure P is increased again such that the urging force generated by the discharge fluid pressure P increased becomes larger than the biasing force Wk of valve spring 44. Accordingly, spool 43 is urged to move toward plug 42 against the biasing force Wk of valve spring 44 again, and is shifted from the first region to the second region. As a result, cam ring 15 is displaced in the concentric direction again.

Thus, in variable displacement pump 100, the discharge fluid pressure P is regulated to retain the first changeover fluid pressure Pf by continuously and alternately allowing fluid communication between first control port 51 and first drain port 53 and fluid communication between first control port 51 and introduction port 50 by using spool 43 of pilot valve 40. Since such discharge fluid pressure regulation is carried out by changeover of fluid communication of first control port 51 in pilot valve 40, the discharge fluid pressure regulation is free from influence of the spring constant of each of first and second springs 33, 34. Further, the discharge fluid pressure regulation is carried out in an extremely narrow range of stroke of spool 43 relating to the changeover of fluid communication of first control port 51 in pilot valve 40. Therefore, there is no fear that the discharge fluid pressure regulation is influenced by the spring constant of valve spring 44. As a result, the discharge fluid pressure P of variable displacement pump 100 exhibits the characteristic as indicated by the flatly extending line segment of the solid line in section "b" in FIG. 6, unlike the characteristic of the conventional pump as indicated by the line segment of the broken line in section "b" in FIG. 6 which increases substantially in proportion to increase in engine rotation speed R. Thus, the discharge fluid pressure P of variable displacement pump 100 in section "b" can be approximated closely to the ideal necessary fluid pressure as indicated by the dashed line in FIG. 6. Accordingly, in variable displacement pump 100, it is possible to reduce power loss (hatched area S1 shown in FIG. 6) which is caused in the conventional pump due to useless increase in the discharge fluid pressure P corresponding to the spring constant of first spring 33. Further, cam ring 15 is controlled by operating pilot valve 40 to introduce the fluid pressure into each of control fluid chambers 31, 32. Therefore, the discharge fluid pressure P can be controlled without being influenced by change in oil temperature or variation in inside pressure in each of control fluid chambers 31, 32 which is caused due to aeration, etc.

When spool 43 is in the second region and the discharge fluid pressure P is increased to allow sufficient fluid communication between first control port 51 and fluid pressure chamber 55 in pilot valve 40 in accordance with increase in engine rotation speed R, the inside pressure of first control fluid chamber 31 is increased to cause displacement of cam ring 15 in the concentric direction and thereby bring the one end of second spring 34 into contact with arm displacement restricting portion 28 (see FIG. 8). That is, assistance of second spring 34 is eliminated, so that displacement of cam ring 15 in the concentric direction is stopped. As a result, as engine rotation speed R becomes higher, the discharge fluid pressure P is increased again substantially in proportion to engine rotation speed R as indicated by the line segment of the solid line in section "c" in FIG. 6. Meanwhile, the eccentric amount of the central axis of cam ring 15 in section "c" is smaller than that in section "a", and therefore, the amount of increase in the discharge fluid pressure P in section "c" becomes smaller than that in section "a".

When the discharge fluid pressure P is further increased and has reached the second changeover fluid pressure Ps in accordance with increase in engine rotation speed R owing to the above characteristic of variable displacement pump 100, spool 43 of pilot valve 40 is further moved toward plug 42 and shifted from the second region to the third region shown in FIG. 9. Accordingly, the fluid communication between first control port 51 and introduction port 50 is maintained, and fluid communication between second control port 52 and first drain port 53 through intermediate chamber 56 is allowed. As a result, the discharge fluid pressure P is introduced into first control fluid chamber 31, and the oil in second control fluid chamber 32 is discharged. Second control fluid chamber 32 is communicated with control pressure introduction passage 60 through orifice 63. With this construction, when the oil is discharged from second control fluid chamber 32 due to the fluid communication between second control port 52 and first drain port 53, pressure loss occurs in orifice 63 to thereby cause reduction of the fluid pressure that is introduced into second control fluid chamber 32. As a result, the urging force generated by the inside pressure of first control fluid chamber 31 becomes larger than the resultant force of the biasing force W1 of first spring 33 and the urging force generated by the inside pressure of second control fluid chamber 32, so that cam ring 15 is started to move again in the concentric direction.

Owing to displacement of cam ring 15 in the concentric direction, the eccentric amount of the central axis of cam ring 15 is reduced to thereby cause decrease in the discharge fluid pressure P. The urging force generated by the discharge fluid pressure P decreased becomes smaller than the biasing force Wk of valve spring 44, so that spool 43 is urged to move from the third region back to the second region by the biasing force Wk of valve spring 44. The fluid communication between second control port 52 and first drain port 53 is interrupted again by second land 43*b*. Accordingly, the discharge fluid pressure P is introduced into second control fluid chamber 32, and therefore, the inside pressure of second control fluid chamber 32 is increased again. As a result, the urging force generated by the inside pressure of first control fluid chamber 31 becomes smaller than the resultant force of the urging force generated by the inside pressure of second control fluid chamber 32 and the biasing force W1 of first spring 33, so that cam ring 15 is brought into the intermediate eccentric state as shown in FIG. 8 again. The discharge fluid pressure P is increased again in accordance with increase in the eccentric amount of the central axis of cam ring 15 during displacement of cam ring 15 to the intermediate eccentric state, and the urging force generated by the discharge fluid pressure P increased overcomes the biasing force Wk of valve spring 44. At this time, spool 43 is urged to move toward plug 42 against the biasing force Wk of valve spring 44 again, and is shifted from the second region to the third region. As a result, cam ring 15 is displaced in the concentric direction again (see section "d" shown in FIG. 6).

Thus, in variable displacement pump 100, the discharge fluid pressure P is regulated to retain the second changeover fluid pressure Ps by continuously and alternately allowing fluid communication between second control port 52 and first drain port 53 and non-fluid communication therebetween by using spool 43 of pilot valve 40. Since such discharge fluid pressure regulation is carried out by changeover between the fluid communication and the non-fluid communication of second control port 52 in pilot valve 40, the discharge fluid pressure regulation can be free from influence of the spring constant of each of first and second springs 33, 34. Further, the discharge fluid pressure regulation is carried out in an extremely narrow range of stroke of spool 43 relating to the changeover between the fluid communication and the non-communication of first control port 51 in pilot valve 40. Therefore, there is no fear that the discharge fluid pressure regulation is influenced by the spring constant of valve spring 44. As a result, the discharge fluid pressure P of variable displacement pump 100 exhibits the characteristic as indicated by the substantially flatly extending line segment of the solid line in section "d" in FIG. 6, unlike the characteristic of the conventional pump as indicated by the line segment of the broken line in section "d" in FIG. 6 which increases substantially in proportion to increase in engine rotation speed R. Thus, the discharge fluid pressure P of variable displacement pump 100 in section "d" can be approximated closely to the ideal necessary fluid pressure as indicated by the dashed line in FIG. 6. Accordingly, in variable displacement pump 100, it is possible to reduce power loss (hatched area S2 shown in FIG. 6) which is caused in the conventional pump due to useless increase in the discharge fluid pressure P corresponding to the spring constant of first spring 33. Further, cam ring 15 is controlled by operating pilot valve 40 to introduce the fluid pressure into each of control fluid chambers 31, 32. Therefore, the discharge fluid pressure P can be controlled without being influenced by change in oil temperature or variation in inside pressure in each of control fluid chambers 31, 32 which is caused due to aeration, etc.

As explained above, in variable displacement pump 100, the discharge fluid pressure P can be retained at desired discharge fluid pressure (first changeover fluid pressure Pf and second changeover fluid pressure Ps) in each of engine rotation speed ranges (section "b" and section "d" in FIG. 6) in which retention of the desired discharge fluid pressure is required.

Further, since such discharge fluid pressure regulation is carried out by pilot valve 40, the discharge fluid pressure regulation can be free from influence of the spring constant of each of first and second springs 33, 34 which is caused in the conventional pump. Furthermore, the discharge fluid pressure regulation is carried out in an extremely narrow range of stroke of spool 43 in pilot valve 40. Therefore, the discharge fluid pressure regulation can be also free from influence of the spring constant of valve spring 44. In other words, it is possible to avoid such inconvenience that useless increase in the discharge fluid pressure P is caused due to influence of the spring constant of each of valve spring 44 and first and second springs 33, 34 (particularly, first spring 33), and retain the discharge fluid pressure P at the desired discharge fluid pressure as described above.

In addition, upon regulating the discharge fluid pressure P in variable displacement pump 100, when spool 43 of pilot valve 40 is in the first region, fluid communication between first control fluid chamber 31 (first control port 51) and first drain port 53 is allowed to discharge the oil in first control fluid chamber 31, and the discharge fluid pressure P is introduced into only second control fluid chamber 32. With this operation of pilot valve 40, it is possible to suppress unstable movement, for instance, fluttering of cam ring 15 which is caused due to introduction of the fluid pressure into both first control fluid chamber 31 and second control fluid chamber 32 and application thereof to cam ring 15, and therefore, attain stable retention of cam ring 15. As a result, it is also possible to serve for stabilization of control of the discharge fluid pressure P in section "a" in FIG. 6.

Referring to FIG. 10 to FIG. 13, there is shown variable displacement pump 200 according to a second embodiment of the present invention, which differs from the first embodiment in construction of a route to supply fluid pressure (discharge fluid pressure) to second control fluid chamber 32. In the first embodiment, the fluid pressure is directly supplied to second control fluid chamber 32 through second introduction passage 62. In contrast, in the second embodiment, the fluid pressure is supplied to second control fluid chamber 32 through pilot valve 40.

Specifically, in variable displacement pump 200, first and second ports 51, 52 are connected to first and second control fluid chambers 31, 32 through first and second supply-discharge passages 65, 66, respectively. Further, first and second supply-discharge passages 65, 66 are communicated with each other through connecting passage 67 having orifice 68. Connecting passage 67 per se can be provided on either inside or outside of variable displacement pump 200. In a case where connecting passage 67 is provided on an inside of variable displacement pump 200, connecting passage 67 can be provided in the form of a groove formed in a mating surface between pump body 11 and cover member 12, so that variable displacement pump 200 can be avoided from increase in size.

An operation of variable displacement pump 200 will be explained hereinafter by referring to FIG. 6 and FIG. 10 to FIG. 13.

Figure 10:
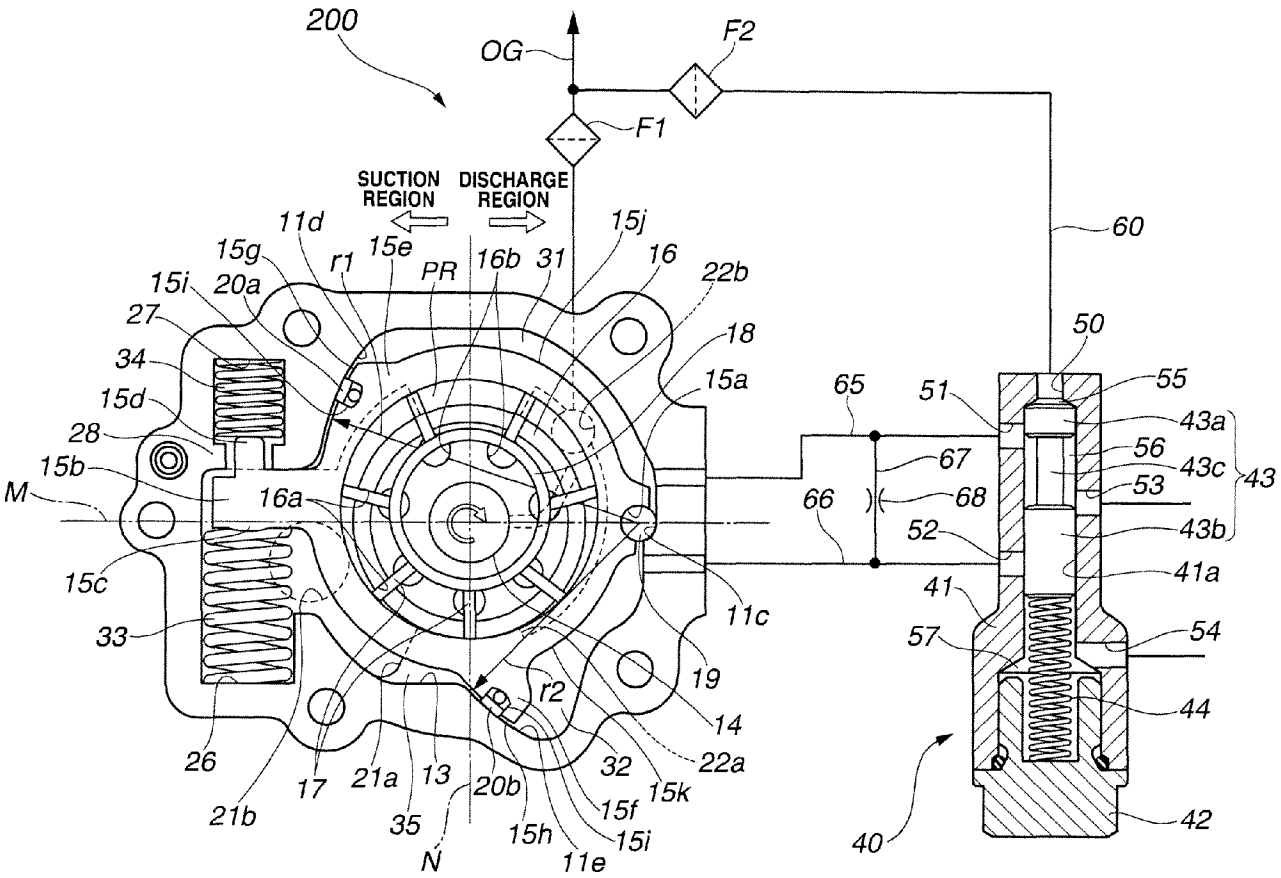
FIG. 10 is a schematic diagram of a variable displacement pump according to a second embodiment of the present invention, showing a construction of the variable displacement pump and a hydraulic circuit thereof.

In variable displacement pump 200, in section "a" shown in FIG. 6 after engine start, the discharge fluid pressure P is lower than the first changeover fluid pressure Pf. Therefore, as shown in FIG. 10, pilot valve 40 is in the first state, that is, spool 43 is in the first region in which fluid communication between introduction port 50 and other ports 51-54 is interrupted by first land 43*a*, fluid communication between first control port 51 and first drain port 53 through intermediate chamber 56 is allowed, and fluid communication between second control port 52 and other ports 50, 51, 53, 54 is interrupted by second land 43*b*. Accordingly, the oil in first control fluid chamber 31 is discharged into the low fluid pressure portion, and the discharge fluid pressure P is supplied to neither first control fluid chamber 31 nor second control fluid chamber 32. As a result, cam ring 15 undergoes the resultant force W0 of the biasing forces W1, W2 of first and second springs 33, 34, that is, only the biasing force W1 of first spring 33 generated by the relatively large spring load. Accordingly, cam ring 15 is held in the maximum eccentric state, so that the amount of the oil discharged by the pump becomes largest, and the discharge fluid pressure P has such a characteristic that the discharge fluid pressure P is increased substantially in proportion to increase in engine rotation speed R.

Figure 11:
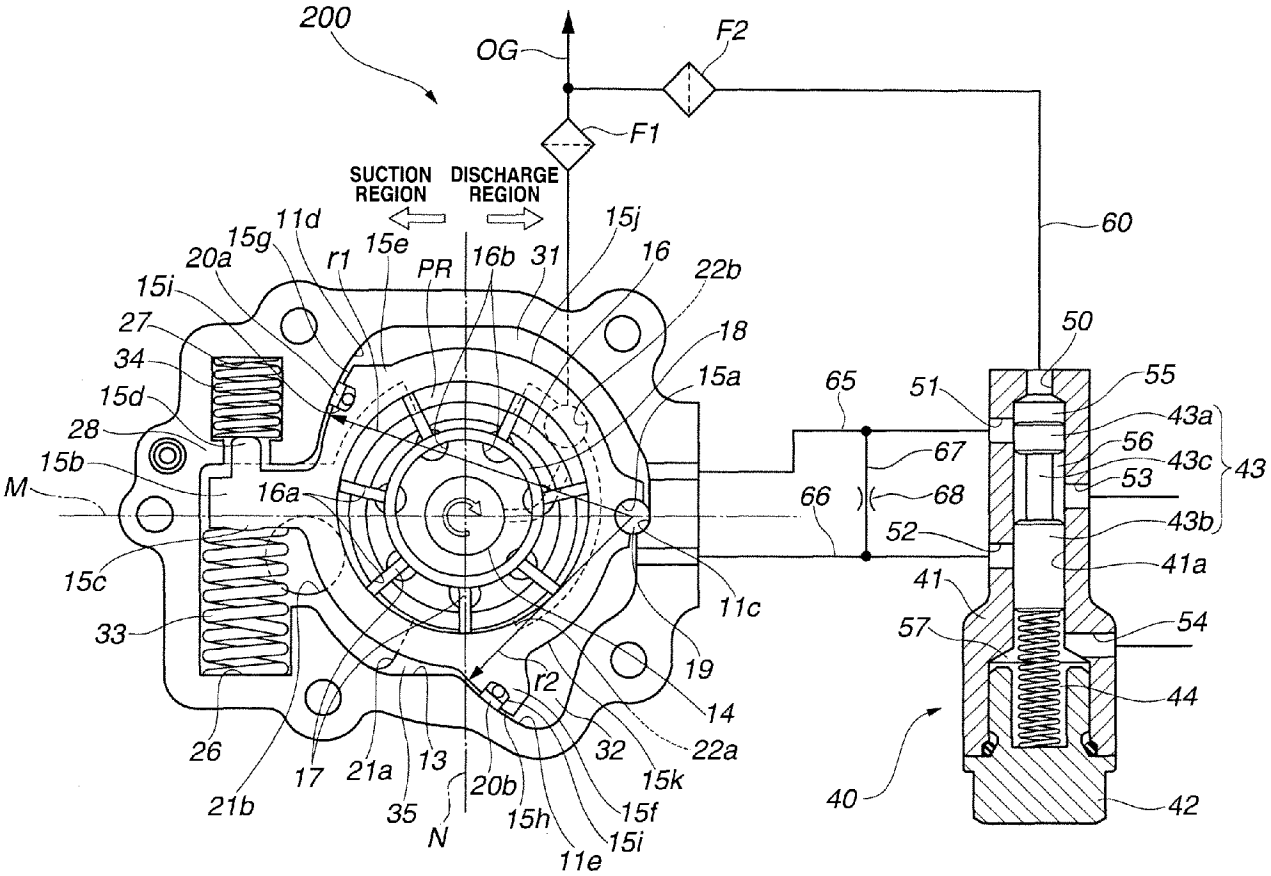
FIG. 11 is a diagram showing a condition of the variable displacement pump according to the second embodiment which corresponds to range "b" shown in FIG. 6.

After that, when the discharge fluid pressure P has reached the first changeover fluid pressure Pf in accordance with increase in engine rotation speed R, spool 43 of pilot valve 40 is moved toward plug 42 against the biasing force of valve spring 44 as shown in FIG. 11 so that spool 43 is shifted from the first region to the second region. In the second region, fluid communication between introduction port 50 and first control port 51 through fluid pressure chamber 55 is allowed, and fluid communication between first control port 51 and first drain port 53 is interrupted by first land 43*a*. On the other hand, fluid communication between second control port 52 and other ports 50, 51, 53, 54 is kept interrupted by second land 43*b*. Accordingly, the fluid pressure introduced from introduction port 50 is supplied to first control fluid chamber 31 through first supply-discharge passage 65, and is also supplied to second control fluid chamber 32 through connecting passage 67 and second supply-discharge passage 66. In this condition, the fluid communication between second control port 52 and first drain port 53 is kept interrupted, so that the oil in second control fluid chamber 32 is not discharged. Therefore, no pressure loss occurs in orifice 68. As a result, the resultant force of the urging force generated by the inside pressure of first control fluid chamber 31 and the biasing force W2 of second spring 34 overcomes the resultant force of the biasing force W1 of first spring 33 and the urging force generated by the inside pressure of second control fluid chamber 32, so that cam ring 15 is started to move in the concentric direction.

Thus, in variable displacement pump 200, the discharge fluid pressure P is regulated to retain the first changeover fluid pressure Pf by continuously and alternately allowing fluid communication between first control port 51 and first drain port 53 and fluid communication between first control port 51 and introduction port 50 by moving spool 43 between the first region and the second region, similarly to variable displacement pump 100 according to the first embodiment. As a result, the discharge fluid pressure P of variable displacement pump 200 exhibits the characteristic as indicated by the substantially flatly extending line segment of the solid line in section "b" in FIG. 6, unlike the characteristic of the conventional pump as indicated by the line segment of the broken line in section "b" in FIG. 6 which increases substantially in proportion to increase in engine rotation speed R. Thus, the discharge fluid pressure P of variable displacement pump 200 in section "b" can be approximated closely to the ideal necessary fluid pressure as indicated by the dashed line in FIG. 6.

Figure 12:
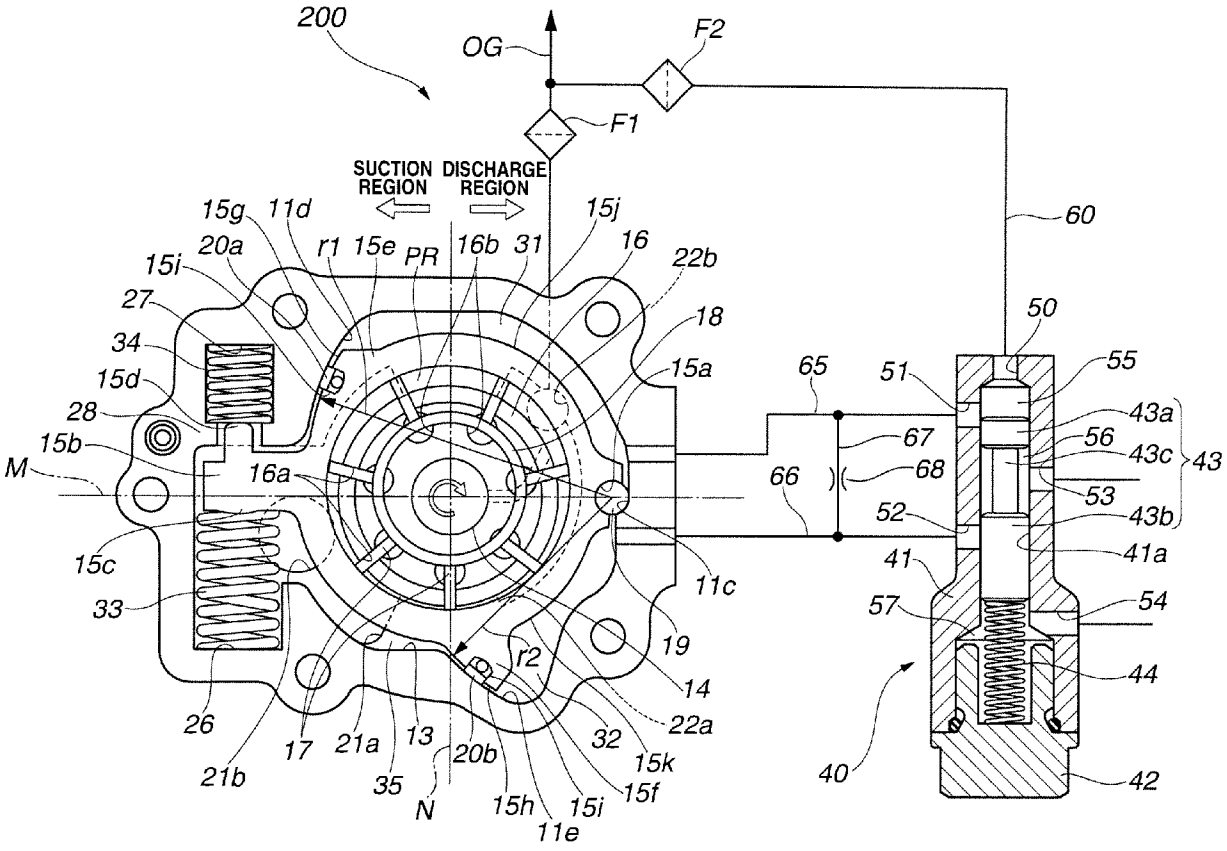
FIG. 12 is a diagram showing a condition of the variable displacement pump according to the second embodiment which corresponds to range "c" shown in FIG. 6.

When spool 43 is in the second region and the discharge fluid pressure P is increased to allow sufficient fluid communication between first control port 51 and fluid fluid pressure chamber 55 in pilot valve 40 in accordance with increase in engine rotation speed R, cam ring 15 is urged to displace in the concentric direction so that the one end of second spring 34 is abutted against arm displacement restricting portion 28 (see FIG. 12). Accordingly, assistance of second spring 34 is eliminated, and displacement of cam ring 15 in the concentric direction is stopped. As a result, as engine rotation speed R becomes higher, the discharge fluid pressure P is increased again substantially in proportion to the engine rotation speed R as indicated by the line segment of the solid line in section "c" in FIG. 6. Similarly to the first embodiment, the amount of increase in discharge fluid pressure P in section "c" is smaller than that in section "a".

Figure 13:
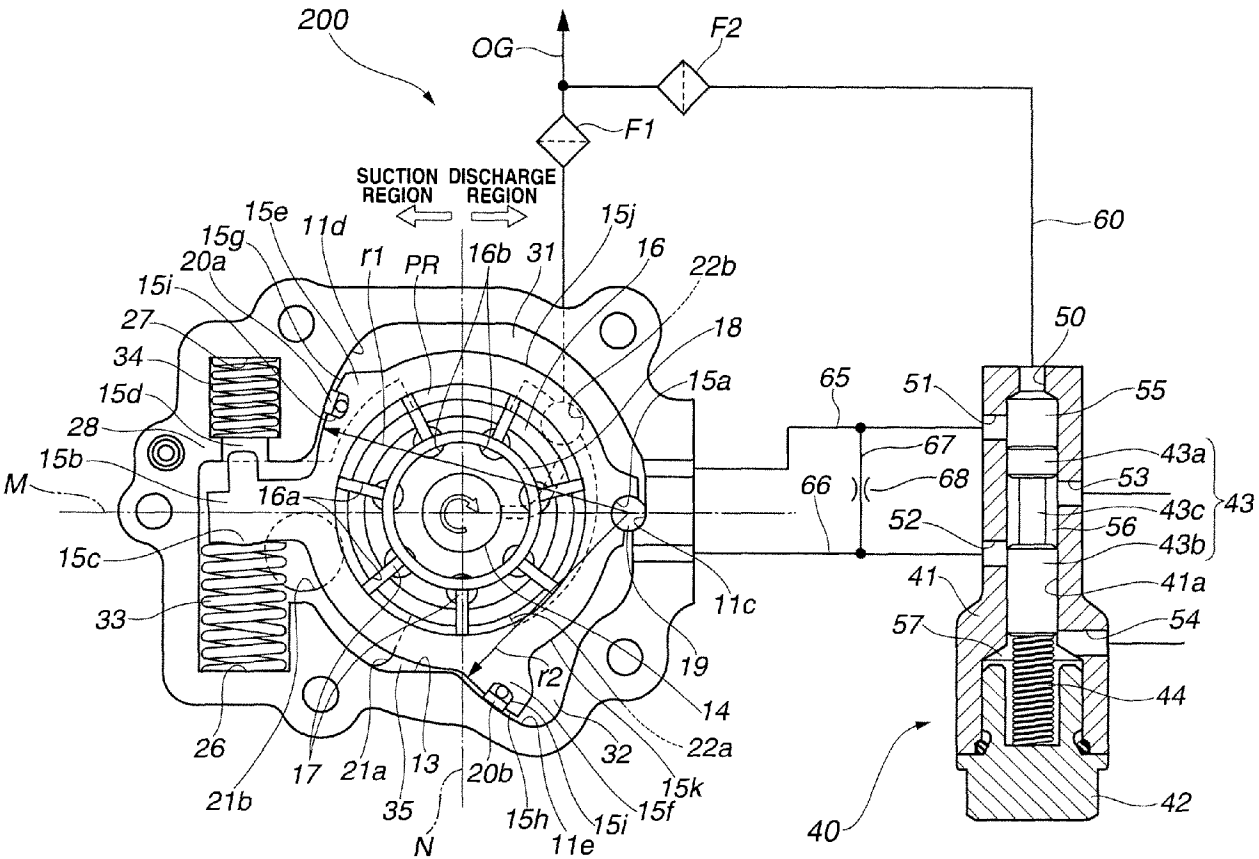
FIG. 13 is a diagram showing a condition of the variable displacement pump according to the second embodiment which corresponds to range "d" shown in FIG. 6.
Figure 14A:
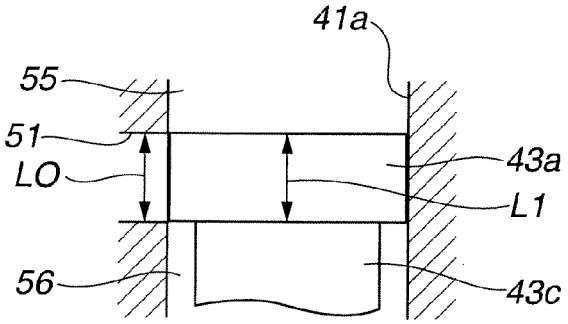
FIGS. 14A-14C are diagrams showing examples of a first land of a spool of a pilot valve and a first control port of the variable displacement pump according to the first and second embodiments, which are different in dimensional relationship therebetween.
Figure 14B:
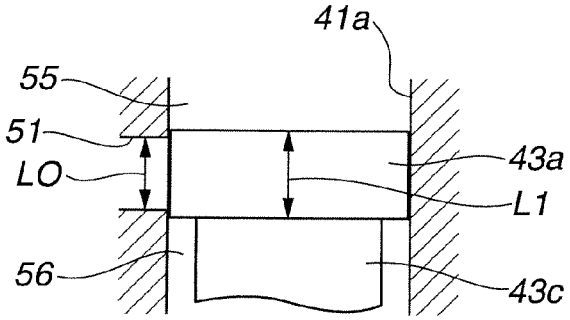
Figure 14C:
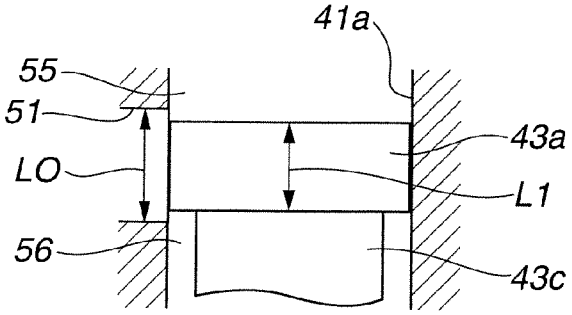
Figure 15A:
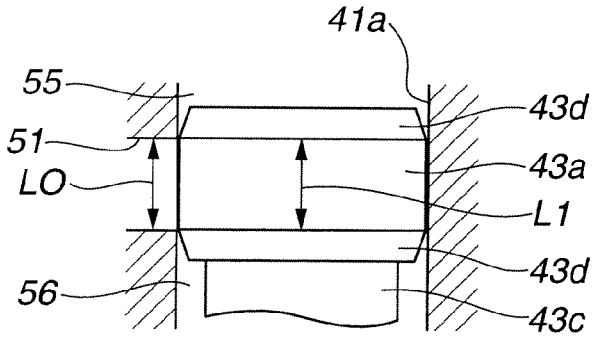
FIGS. 15A-15C are diagrams showing modifications of the spool (first land) of the pilot valve of the variable displacement pump according to the first and second embodiments.
Figure 15B:
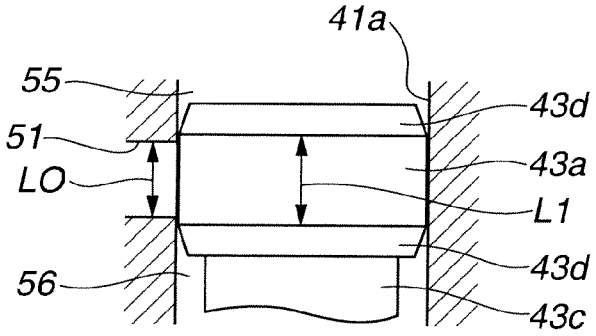
Figure 15C:
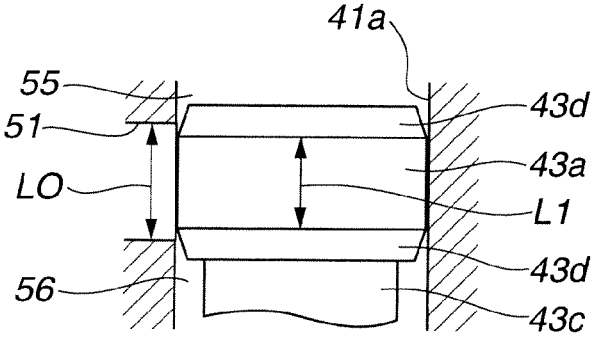

When the discharge fluid pressure P is further increased and has reached the second changeover fluid pressure Ps in accordance with increase in engine rotation speed R owing to the above characteristic of variable displacement pump 200, spool 43 of pilot valve 40 is further moved toward plug 42 and shifted from the second region to the third region shown in FIG. 13. Accordingly, the fluid communication between first control port 51 and introduction port 50 is maintained, and fluid communication between second control port 52 and first drain port 53 through intermediate chamber 56 is allowed. As a result, the discharge fluid pressure P is introduced into first control fluid chamber 31, and the oil in second control fluid chamber 32 is discharged. Due to discharge of the oil from second control fluid chamber 32, pressure loss occurs in orifice 68, thereby causing reduction of the fluid pressure that is introduced into second control fluid chamber 32. Accordingly, the urging force generated by the inside pressure in first control fluid chamber 31 becomes larger than the resultant force of the biasing force W1 of first spring 33 and the urging force generated by the inside pressure in second control fluid chamber 32, so that cam ring 15 is started to further move in the concentric direction.

Thus, in variable displacement pump 200, the discharge fluid pressure P is regulated to retain the second changeover fluid pressure Ps by continuously and alternately allowing fluid communication between second control port 52 and first drain port 53 and non-fluid communication therebetween by moving spool 43 between the second region and the third region, similarly to variable displacement pump 100 according to the first embodiment. As a result, the discharge fluid pressure P of variable displacement pump 200 exhibits the characteristic as indicated by the substantially flatly extending line segment of the solid line in section "d" in FIG. 6, unlike the characteristic of the conventional pump as indicated by the line segment of the broken line in section "d" in FIG. 6 which increases substantially in proportion to increase in engine rotation speed R. Thus, the discharge fluid pressure P of variable displacement pump 200 in section "d" can be approximated closely to the ideal necessary fluid pressure as indicated by the dashed line in FIG. 6.

As explained above, the second embodiment also can perform same function and effect as those of the first embodiment. The second embodiment can retain the desired discharge fluid pressure P in an engine rotation speed range in which retention of the desired discharge fluid pressure is required.

The present invention is not particularly limited to the above embodiments. For instance, fluid pressures P1-P3 required by the engine and first and second changeover fluid pressures Pf, Ps can be freely changed in accordance with specifications of an internal combustion engine, a valve timing control apparatus, etc. of a vehicle to which the variable displacement pump of the present invention is mounted.

Further, in the above embodiments, the fluid communication between first control port 51 and introduction port 50 and the fluid communication between first control port 51 and first drain port 53 are carried out by first land 43*a*. Various modifications of first land 43*a* can be made as follows.

Referring to FIG. 13A to FIG. 13C, there are shown modifications of first land 43*a* in which dimension of first land 43*a* with respect to first control port 51 is optionally changed. As shown in FIG. 13A, first land 43*a* has width L1 in the axial direction of spool 43 which is substantially equal to width L0 of an opening of first control port 51. As shown in FIG. 13B, first land 43*a* has width L1 in the axial direction of spool 43 which is slightly larger than width L0 of the opening of first control port 51. As shown in FIG. 13C, first land 43*a* has width L1 in the axial direction of spool 43 which is slightly smaller than width L0 of the opening of first control port 51. By thus modifying a relative dimension of width L1 of first land 43*a* and width L0 of the opening of first control port 51, it is possible to optionally control the amount of fluid pressure which is supplied to first control fluid chamber 31 and the like in accordance with stroke of spool 43. Further, while such modified dimension of width L1 of first land 43*a* and width L0 of the opening of first control port 51 is retained, tapered chamfered portions 43*d*, 43*d* can be formed at both end edges of first land 43*a* at which opposite end surfaces of first land 43*a* encounter a peripheral side surface thereof.

In addition, in the above embodiments, cam ring 15 serves as the moveable member, and cam ring 15, control fluid chambers 31, 32 and coil springs 33, 34 cooperate with each other to constitute the volume change mechanism. However, in a case where the variable displacement pump of the present invention is applied to other types of a variable displacement pump, for instance, a torochoid pump, an outer rotor constituting an external gear can serve as the moveable member. In such a case, the outer rotor is disposed to move eccentrically as well as cam ring 15, and the control fluid chambers and the springs are disposed on an outer peripheral side of the outer rotor. The volume change mechanism can be thus constructed.

In addition, in the above embodiments, the pump discharge amount is variably controlled by a swing operation of cam ring 15. However, the pump discharge amount can be variably controlled by linearly moving cam ring 15 in the radial direction thereof. In other words, a manner of displacement of cam ring 15 is not particularly limited as long as the pump discharge amount (the rate of change in volume of the pump chamber PR) is variably controlled.

This application is based on prior Japanese Patent Application No. 2012-258828 filed on Nov. 27, 2012. The entire contents of the Japanese Patent Application No. 2012-258828 are hereby incorporated by reference. Although the invention has been described above by reference to certain embodiments of the invention and modifications of the embodiments, the invention is not limited to the embodiments and modifications described above. Further variations of the embodiments and modifications described above will occur to those skilled in the art in light of the above teachings. The scope of the invention is defined with reference to the following claims.

What is claimed is:

1. A variable displacement pump comprising:

a rotor disposed to be driven to rotate about a rotation axis;

a plurality of vanes disposed on an outer peripheral portion of the rotor so as to be moveable to project from the rotor and retreat into the rotor;

a cam ring accommodating the rotor and the plurality of vanes in an inner peripheral side thereof, the cam ring cooperating with the rotor and the plurality of vanes to define a plurality of working fluid chambers, the cam ring being moveable to vary an eccentric amount of a central axis thereof with respect to the rotation axis of the rotor such that a volume of each of the working fluid chambers is increased and decreased during rotation of the rotor, end walls disposed at opposite axial ends of the cam ring, respectively, at least one of the end walls comprising a suction portion and a discharge portion, the suction portion being opened to the working fluid chambers that are increased in volume by and according to rotation of the rotor, the discharge portion being opened to the working fluid chambers that are decreased in volume by and according to rotation of the rotor, a biasing mechanism comprising two biasing members disposed with preloads, respectively, the biasing mechanism being constructed to bias the cam ring in a direction in which the eccentric amount is increased in accordance with a biasing force generated by the two biasing members, the biasing mechanism being constructed such that the biasing force becomes discontinuous when the eccentric amount is a predetermined amount, a first control fluid chamber into which a working fluid discharged from the discharge portion is introduced, the first control fluid chamber serving to apply an urging force to the cam ring in accordance with an inside pressure thereof in a direction in which the eccentric amount is reduced against the biasing force of the biasing mechanism, a second control fluid chamber into which the working fluid discharged from the discharge portion is introduced through an orifice, the second control fluid chamber cooperating with the biasing mechanism to apply an urging force to the cam ring in accordance with an inside pressure thereof in the direction in which the eccentric amount is increased, and a control mechanism serving to control movement of the cam ring, the control mechanism comprising a valve body, a spool slidably accommodated in a side of one axial end of the valve body and a control spring accommodated in a side of the other axial end of the valve body, the valve body comprising an introduction port disposed at the one axial end of the valve body, the introduction port serving to introduce the working fluid discharged into the valve body, a first control port communicated with the first control fluid chamber, a second control port communicated with the second control fluid chamber and a drain port communicated with a low fluid pressure portion, the spool carrying out changeover of fluid communication between the introduction port, the first control port, the second control port and the drain port corresponding to a position of the spool in an axial direction of the valve body with respect to the valve body, the control spring biasing the spool toward the one axial end of the valve body with a biasing force smaller than the biasing force of the biasing mechanism, wherein the control mechanism is shiftable between a first state, a second state and a third state, when fluid pressure introduced into the introduction port is a first changeover fluid pressure or less, the control mechanism is in the first state, in which fluid communication between the introduction port and the remaining ports is restrained, fluid communication between the first control port and the drain port is allowed, and fluid communication between the second control port and the drain port is restrained, when the fluid pressure introduced into the introduction port is higher than the first changeover fluid pressure and is a second changeover fluid pressure or less, the control mechanism is in the second state, in which the fluid communication between the introduction port and the first control port is allowed, the fluid communication between the first control port and the drain port is restrained, and the fluid communication between the second control port and the drain port is restrained, and when the fluid pressure introduced into the introduction port exceeds the second changeover fluid pressure, the control mechanism is in the third state, in which the fluid communication between the introduction port and the first control port is allowed, the fluid communication between the first control port and the drain port is restrained, and the fluid communication between the second control port and the drain port is allowed.

2. The variable displacement pump as claimed in claim 1, wherein the spool comprises large diameter lands formed on opposite axial ends of the spool such that the large diameter lands are slidable relative to the valve body and a small diameter portion between the large diameter lands, the small diameter portion serving to allow fluid communication between the first control port and the drain port or fluid communication between the second control port and the drain port, the large diameter lands serving to restrain fluid communication between the second control port and the drain port.

3. The variable displacement pump as claimed in claim 1, wherein the introduction port is opened to an end surface at the one axial end of the valve body.

4. The variable displacement pump as claimed in claim 1, wherein one of the two biasing members applies the biasing force to the cam ring in the direction in which the eccentric amount is increased, and the other of the two biasing members applies the biasing force to the cam ring in the direction in which the eccentric amount is reduced.

5. The variable displacement pump as claimed in claim 1, wherein the first control fluid chamber and the second control fluid chamber are disposed on an outer peripheral side of the cam ring.

6. The variable displacement pump as claimed in claim 1, wherein the working fluid discharged is used to lubricate an internal combustion engine.

7. The variable displacement pump as claimed in claim 6, wherein the working fluid discharged is used in an oil jet device that supplies the working fluid to a drive source of a variable valve operating mechanism and a piston of the internal combustion engine.

8. A variable displacement pump comprising:

a rotor disposed to be driven to rotate about a rotation axis;

a plurality of vanes disposed on an outer peripheral side of the rotor so as to be moveable to project from the rotor and retreat into the rotor;

a cam ring accommodating the rotor and the plurality of vanes in an inner peripheral side thereof, the cam ring cooperating with the rotor and the plurality of vanes to define a plurality of working fluid chambers, the cam ring being moveable to vary an eccentric amount of a central axis thereof with respect to the rotation axis of the rotor such that a volume of each of the working fluid chambers is increased and decreased during rotation of the rotor, end walls disposed at opposite axial ends of the cam ring, respectively, at least one of the end walls comprising a suction portion and a discharge portion, the suction portion being opened to the working fluid chambers that are increased in volume by and according to rotation of the rotor, the discharge portion being opened to the working fluid chambers that are decreased in volume by and according to rotation of the rotor, a biasing mechanism comprising two biasing members disposed with preloads, respectively, the biasing mechanism being constructed to bias the cam ring in a direction in which the eccentric amount is increased in accordance with a biasing force generated by the two biasing members, the biasing mechanism being constructed such that the biasing force becomes discontinuous when the eccentric amount is a predetermined amount, a first control fluid chamber into which a working fluid discharged from the discharge portion is introduced, the first control fluid chamber serving to apply an urging force to the cam ring in accordance with an inside pressure thereof in a direction in which the eccentric amount is reduced against the biasing force of the biasing mechanism, a second control fluid chamber into which the working fluid discharged from the discharge portion is introduced through an orifice, the second control fluid chamber cooperating with the biasing mechanism to apply an urging force to the cam ring in accordance with an inside pressure thereof in the direction in which the eccentric amount is increased, and a control mechanism serving to control movement of the cam ring, wherein when fluid pressure discharged from the discharge portion is a first changeover fluid pressure or less, the control mechanism is in a first state in which a flow of the working fluid from the discharge portion to the first control fluid chamber is restrained, and the working fluid in the first control fluid chamber is discharged to a low fluid pressure portion, when the fluid pressure discharged from the discharge portion is higher than the first changeover fluid pressure and is a second changeover fluid pressure or less, the control mechanism is in a second state in which the discharge portion and the first control fluid chamber are fluidly communicated, a flow of the working fluid from the first control fluid chamber to the low fluid pressure portion is restrained, and a flow of the working fluid from the second control fluid chamber to the low fluid pressure portion is restrained, when the fluid pressure discharged from the discharge portion exceeds the second changeover fluid pressure, the control mechanism is in a third state in which the discharge portion and the first control fluid chamber are fluidly communicated, a flow of the working fluid from the first control fluid chamber to the low fluid pressure portion is restrained, and the working fluid in the second control fluid chamber is discharged into the low fluid pressure portion.

9. A variable displacement pump comprising:

a pump element constructed to be rotatably driven to introduce a working fluid from a suction portion into the pump element and discharge the working fluid from a discharge portion, the pump element being constructed such that as the pump element is rotated, volumes of a plurality of working fluid chambers are varied, a volume change mechanism comprising a moveable member, the volume change mechanism serving to vary an amount of volumetric change of each of the plurality of working fluid chambers opened to the discharge portion by movement of the moveable member, a biasing mechanism comprising two biasing members disposed with preloads, respectively, the biasing mechanism being constructed to bias the moveable member in a direction in which the amount of volumetric change of each of the plurality of working fluid chambers opened to the discharge portion is increased in accordance with a biasing force generated by the two biasing members, the biasing mechanism being constructed such that the biasing force discontinuously changes when the amount of volumetric change of each of the plurality of working fluid chambers opened to the discharge portion becomes a predetermined amount, a first control fluid chamber into which the working fluid discharged from the discharge portion is introduced, the first control fluid chamber serving to apply an urging force to the moveable member in accordance with an inside pressure thereof in a direction opposite to that of the biasing force of the biasing mechanism, a second control fluid chamber into which the working fluid discharged from the discharge portion is introduced through an orifice, the second control fluid chamber serving to apply an urging force to the moveable member in accordance with an inside pressure thereof in a same direction as a direction of the biasing force of the biasing mechanism, and a control mechanism serving to control movement of the moveable member, the control mechanism being operative such that when fluid pressure discharged from the discharge portion is a first changeover fluid pressure or less, a flow of the working fluid from the discharge portion to the first control fluid chamber is restrained, and the working fluid in the first control fluid chamber is discharged to a low fluid pressure portion, when the fluid pressure discharged from the discharge portion is higher than the first changeover fluid pressure and is a second changeover fluid pressure or less, the working fluid is introduced into the first control fluid chamber, and a flow of the working fluid from the second control fluid chamber to the low fluid pressure portion is restrained, and when the fluid pressure discharged from the discharge portion is higher than the second changeover fluid pressure, the working fluid is introduced into the first control fluid chamber, and the working fluid in the second control fluid chamber is discharged into the low fluid pressure portion.

* * * * *